US009528242B2

(12) United States Patent
Oyama et al.

(10) Patent No.: US 9,528,242 B2
(45) Date of Patent: Dec. 27, 2016

(54) FRONT LOADER WITH SWING LINK MEMBER

(71) Applicant: KUBOTA CORPORATION, Osaka (JP)

(72) Inventors: Kosuke Oyama, Duluth, GA (US); Kenzo Ushiro, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 107 days.

(21) Appl. No.: 14/492,586

(22) Filed: Sep. 22, 2014

(65) Prior Publication Data

US 2015/0098785 A1 Apr. 9, 2015

(30) Foreign Application Priority Data

Oct. 4, 2013 (JP) ..... 2013-209472
Aug. 6, 2014 (JP) ..... 2014-160583

(51) Int. Cl.
*E02F 3/34* (2006.01)
*E02F 3/43* (2006.01)

(52) U.S. Cl.
CPC ..... *E02F 3/3411* (2013.01); *E02F 3/433* (2013.01)

(58) Field of Classification Search
CPC ..... E02F 3/433; E02F 3/3411
See application file for complete search history.

(56) References Cited

U.S. PATENT DOCUMENTS 2,645,369 A 7/1953 Allan
RE24,746 E * 12/1959 Pilch ..... E02F 3/3411 414/713
3,076,571 A * 2/1963 Kuhl ..... E02F 3/3411 414/713
3,203,564 A * 8/1965 Brekelbaum ..... E02F 3/3411 414/702
3,237,792 A * 3/1966 Boehmer ..... E02F 3/3411 414/713
3,521,781 A * 7/1970 Holsinger ..... E02F 3/433 414/701
3,534,881 A * 10/1970 Horsch ..... E02F 3/3405 414/699
3,536,216 A * 10/1970 Woolman ..... E02F 3/436 414/694

(Continued)

FOREIGN PATENT DOCUMENTS

DE 1 230 359 12/1966
DE 34 29 214 2/1986

(Continued)

*Primary Examiner* — Gerald McClain
(74) *Attorney, Agent, or Firm* — Greenblum & Bernstein, P.L.C.

(57) ABSTRACT

A front loader includes a mechanical posture maintaining mechanism for maintaining the posture of an implement, regardless of swing displacement of a boom. The boom is formed in a curved shape in which a longitudinal central side thereof is located above. The posture maintaining mechanism includes a swing link member having an inner free-end part and an outer free-end part and disposed at a longitudinal center location of the boom so as to be swingable about a third horizontal pivot as a fulcrum. A base-end link member extends between a fixed bracket and the inner free-end part and a free-end link member links the outer free-end part to the implement.

21 Claims, 14 Drawing Sheets

(56) References Cited

U.S. PATENT DOCUMENTS

| | | | | | |
|---|---|---|---|---|---|
| 3,698,583 | A * | 10/1972 | Shore | E02F 3/432 | 414/701 |
| 3,722,724 | A * | 3/1973 | Blakely | E02F 3/283 | 414/697 |
| 4,431,364 | A * | 2/1984 | Redenbarger | E02F 3/433 | 414/697 |
| 4,825,568 | A * | 5/1989 | Kawamura | E02F 3/432 | 414/722 |
| 6,309,171 | B1 | 10/2001 | Arck | | |
| 7,059,422 | B2 * | 6/2006 | Burgin | E02F 3/433 | 172/274 |
| 8,845,265 | B2 * | 9/2014 | Oyama | E02F 3/3417 | 414/700 |
| D760,811 | S * | 7/2016 | Uchijima | D15/28 | |
| 2007/0031233 | A1 | 2/2007 | Frey | | |

FOREIGN PATENT DOCUMENTS

| | | | | |
|---|---|---|---|---|
| DE | 198 00 164 | | 7/1999 | |
| DE | 101 62 016 | | 7/2003 | |
| DE | 10162016 | A1 * | 7/2003 | E02F 3/34 |
| DE | 10 2006 003 768 | | 7/2007 | |
| DE | 102006003768 | A1 * | 7/2007 | B62D 33/0617 |
| DE | 20 2007 007 452 | | 11/2007 | |
| DE | EP 1903147 | A2 * | 3/2008 | E02F 3/3411 |
| EP | 1 903 147 | | 1/2010 | |
| JP | 2000-170200 | | 6/2000 | |
| JP | 2000170200 | A * | 6/2000 | |
| KR | 10-2010-0111959 | * | 10/2010 | |

* cited by examiner

FRONT LOADER WITH SWING LINK MEMBER

CROSS-REFERENCE TO RELATED APPLICATION(S)

The instant application claims priority under 35 U.S.C. §119 to Japanese Patent Application Nos. 2013-209472, which was filed on Oct. 4, 2013 and 2014-160583, which was filed Aug. 6, 2014, the entire disclosure of each Japanese application is hereby incorporated by reference.

TECHNICAL FIELD

The present invention relates to a front loader including fixed brackets mounted to a vehicle body, booms mounted to the fixed brackets so as to be vertically swingable about first horizontal pivots as fulcrums, an implement mounted to free-end parts of the booms so as to be swingable about second horizontal pivots as fulcrums, and/or a mechanical posture maintaining mechanism for maintaining a posture of the implement regardless of the swing displacements of the booms.

BACKGROUND OF THE INVENTION

As disclosed in EP1903147A3, in such front loaders, some posture maintaining mechanisms (mechanical parallel guide mechanism) are each comprised of a swing link member (three-point swing lever body 5), a base-end link member (link rod 3), a free-end link member (work cylinder 13). The swing link member has two free-end parts and is disposed of a longitudinal central location of a boom so as to be swingable about a third horizontal pivot (three-point swing axis 18) as a fulcrum. The base-end link member is bridged between a fixed bracket (columnar body 4) and one of the free-end parts of the swing link member. The free-end link member links the other free-end part of the swing link member to an implement. With above construction, the front loader operates so as to expand and contract by the interlocking action with the vertical swing of the booms, while maintaining the posture of the implement by the extending-and-contracting operation regardless of the swing displacements of the booms.

In the front loader disclosed in EP1903147A3, each boom (swing boom 2) is formed in a sharply-curved shape where a longitudinal central part thereof is upwardly convex. Meanwhile, the posture maintaining mechanism is configured so that a base-end link member (link rod 3), one of the free-end parts of the swing link member (three-point swing lever body 5) coupled to the base-end link member, etc. are located inwardly from the upper surface of the boom (i.e., on the inside of the boom elbow). Further, the posture maintaining mechanism is configured so that the other free-end part of the swing link member and the free-end link member (work cylinder 13) coupled to the other free-end part, etc. are located outwardly from the upper surface of the boom (i.e., on the outer side of the boom elbow). The other free-end part of the swing link member is configured in a base-end boom part located toward the fixed bracket (columnar body 4) from the bent point of the boom so that the other free-end part greatly projects upwardly from the upper surface of the boom.

With the above configuration, in a low position operating state in which the booms are lowered to a height so that the implement contacts or substantially contacts the ground surface, a field of view of an vehicle operator who rides the vehicle body is significantly interrupted by the other free-end part of the swing link member which greatly projects upwardly from the upper surface of the boom, with one end of the free-end link member coupled to the other free-end part, etc. Therefore, since visibility from the vehicle body side is reduced or impaired in the low position operating state in which the boom is lowered, the low position operation is difficult to perform and, thus, there is a need to improve the operability of the vehicle in the low position operating state.

SUMMARY OF THE INVENTION

One purpose of the present invention is to improve operability of a front loader in a low position operating state.

According to one aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that the boom is provided with a base-end boom part located on the first pivot side from a peak that is furthest from the center-to-center straight line and a free-end boom part located on the second pivot side from the peak, and the free-end boom part being provided with the third pivot.

According to non-limiting aspects of the above configuration, the free-end boom part of the boom can be provided with the swing link member as well as the third pivot. In the low position operating state in which the boom is lowered to the height where the implement contacts or substantially contacts the ground surface, the free-end boom part is part which hangs over downwardly from the peak of the boom, by a larger vertical distance than the base-end boom. Therefore, for example, as compared with a case where the base-end boom part is provided to the swing link member, the height of the swing link member with respect to the boom can be lowered in the low position operating state.

Thereby, in the low position operating state, the projecting amount of, for example, the swing link member which projects upwardly from the upper end of the boom in a downward line-of-sight direction when an operator who rides the vehicle body views, for example, the boom, can be reduced.

As a result, in the low position operating state, an area interrupted, for example, by the outer free-end part of the swing link member from a field of view of the operator who rides the vehicle body can be reduced. The visibility of the operating state from the vehicle body side in the low position operation state can be improved by the reduced amount of the interruption area, and the low position operation can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is characterized in that the center of the third pivot is configured to be located within an area on the second pivot side from a boundary line including the boundary line, the boundary line extending perpendicularly from the center-to-center straight line at ½ location of a center-to-center distance between the center of the first pivot and the center of the second pivot of the boom.

According to non-limiting aspects of the above configuration, part of the boom on the second pivot side can be provided with the swing link member as well as the third pivot. The part on the second pivot side is part of the boom which hangs over downwardly by a larger vertical distance than part on the first pivot side from a boundary line in the low position operating state. Therefore, for example, as compared with a case where the swing link member is provided to part of the boom on the first pivot side from the boundary line, the height of the swing link member can be lowered with respect to the boom in the low position operating state.

Thereby, in the low position operating state, the projecting amount of, for example, the swing link member which projects upwardly from the upper end of the boom in the downward line-of-sight direction when the operator who rides the vehicle body views, for example, the boom, can be reduced.

As a result, in the low position operating state, the area interrupted, for example, by the outer free-end part of the swing link member from the field of view of the operator who rides the vehicle body can be reduced. The visibility of the operating state from the vehicle body side in the low position operating state can be improved by the reduced amount of the interruption area, and the low position operation can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that the swing link member is disposed on the second pivot side from a peak furthest from the center-to-center straight line of the boom.

According to non-limiting aspects of the above configuration, the second pivot side of the boom provided with the swing link member is the side which hangs over downwardly from the peak of the boom in the low position operating state by a larger vertical distance than the first pivot side. Therefore, for example, as compared with a case where the swing link member is provided to the first pivot side from the peak of the boom, the height of the swing link member can be lowered with respect to the boom in the low position operating state.

Thereby, in the low position operating state, the projecting amount of, for example, the swing link member which projects upwardly from the upper end of the boom in the downward line-of-sight direction when the operator who rides the vehicle body views, for example, the boom, can be reduced.

As a result, in the low position operating state, the area interrupted, for example, by the outer free-end part of the swing link member from the field of view of the operator who rides the vehicle body can be reduced. The visibility of the operating state from the vehicle body side in the low position operating state can be improved by the reduced amount of the interruption area, and the low position operation can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that, in a low position operating state in which the boom is lowered to a height where the implement contacts or substantially contacts the ground surface, an upper end of the outer free-end part is configured to be located below an upper end of the boom in a downward line-of-sight direction when an operator sitting on an operator's seat of the vehicle body views the boom.

According to non-limiting aspects of the above configuration, in the low position operating state, the area interrupted, for example, by the outer free-end part of the swing link member from the field of view of the operator who is sitting on the operator's seat of the vehicle body can be eliminated.

As a result, the visibility of the operating state from the vehicle body side in the low position operating state can be improved, and the low position operating state can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that the center of the third pivot is configured to be located on the second pivot side from an intersection between a first reference line from the first pivot side of the boom and a second reference line from the second pivot side of the boom. The front loader is also characterized in that the first reference line is a line perpendicular to a first perpendicular line at an intersection between the first perpendicular line and the upper surface of the boom, the first perpendicular line extends through the center of the first pivot and intersects perpendicularly to the upper surface of the boom. The front loader is also characterized in that the second reference line is a line perpendicular to a second perpendicular line at an intersection between the second perpendicular line and the upper surface of the boom, the second perpendicular line extends through the center of the second pivot and intersects perpendicularly to the upper surface of the boom.

According to non-limiting aspects of the above configuration, the swing link member as well as the third pivot can be provided on the second pivot side from the intersection between the first reference line and the second reference line of the boom. In the low position operating state, the second pivot side from the intersection between the first reference line and the second reference line of the boom is the side which hangs over downwardly by a larger vertical distance than the first pivot side from the intersection between the first reference line and the second reference line of the boom. Therefore, for example, as compared with a case where the swing link member is provided to the first pivot side from the intersection between the first reference line and the second reference line of the boom, the height of the swing link member can be lowered with respect to the boom in the low position operating state.

Thereby, in the low position operating state, the projecting amount of, for example, the swing link member which projects upwardly from the upper end of the boom in the downward line-of-sight direction when the operator who rides the vehicle body views, for example, the boom, can be reduced.

As a result, in the low position operating state, the area interrupted, for example, by the outer free-end part of the swing link member from the field of view of the operator who rides the vehicle body can be reduced. The visibility of the operating state from the vehicle body side in the low position operating state can be improved by the reduced amount of the interruption area, and the low position operation can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that the swing link member is configured so that the third pivot, a first coupling shaft coupling the inner free-end part to the base-end link member, and a second coupling shaft coupling the outer free-end part to the free-end link member are disposed in a triangular shape. The front loader is also characterized in that, in a low position operating state in which the boom is lowered to a height where the implement contacts or substantially contacts the ground surface, an area of 25% or less on the second coupling shaft side of the area of the triangle having the center of the third pivot of the swing link member, the center of the first coupling shaft, and the center of the second coupling shaft as vertexes is exposed outside the boom.

According to non-limiting aspects of the above configuration, in the low position operating state, the amount of the swing link member exposed outside from the upper surface of the boom can be reduced down to about ¼ of the entire swing link member.

Thereby, in the low position operating state, the projecting amount of, for example, the swing link member which projects upwardly from the upper end of the boom in the downward line-of-sight direction when the operator who rides the vehicle body views, for example, the boom, can be reduced.

As a result, in the low position operating state, the area interrupted, for example, by the outer free-end part of the swing link member from the field of view of the operator who rides the vehicle body can be reduced. The visibility of the operating state from the vehicle body side in the low position operating state can be improved by the reduced amount of the interruption area, and the low position operation can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that the boom is provided with a base-end boom part located on the first pivot side from a peak that is furthest from the center-to-center straight line and a free-end boom part located on the second pivot side from the peak. The front loader is also characterized in that, in a low position operating state in which the boom is lowered to a height where the implement contacts or substantially contacts the ground surface, the outer free-end part is configured to project forward in vehicle body longitudinal directions from the free-end part of the boom.

According to non-limiting aspects of the above configuration, the free-end boom part where the outer free-end part of the swing link member projects is part which hangs over downwardly by a larger vertical distance than the base-end boom part from the peak of the boom in the low position operating state. Therefore, for example, as compared with a case where the outer free-end part of the swing link member projects upwardly from the base-end boom part, the projecting amount of, for example, the swing link member which projects upwardly from the upper end of the boom in the downward line-of-sight direction when the operator who rides the vehicle body views, for example, the boom, can be reduced.

As a result, in the low position operating state, an area interrupted, for example, by the outer free-end part of the swing link member from the field of view of the operator who rides the vehicle body can be reduced. The visibility of the operating state from the vehicle body side in the low position operating state can be improved by the reduced amount of the interruption area, and the low position operation can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a curved shape in which a longitudinal central side of the boom is located above a center-to-center straight line connecting between the center of the first pivot and the center of the second pivot. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the implement. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that the boom is provided with a base-end boom part located on the first pivot side from a peak that is furthest from the center-to-center straight line and a free-end boom part located on the second pivot side from the peak. The front loader is also characterized in that, in a low position operating state in which the boom is lowered to a height where the implement contacts or substantially contacts the ground surface, the outer free-end part is configured to be located below the peak.

According to non-limiting aspects of the above configuration, in the low position operating state, the area interrupted by the outer free-end part of the swing link member from the field of view when the operator who rides the vehicle body views, for example, the boom can be eliminated. Thereby, the visibility of the operating state from the vehicle body side in the low position operating state can be improved, and the low position operation can be easily performed.

Therefore, operability in the low position operating state can be improved.

According to another aspect of the present invention, a front loader is provided which includes a fixed bracket mounted to a vehicle body, a boom mounted to the fixed bracket so as to be vertically swingable about a first horizontal pivot as a fulcrum, an implement mounted to a free-end part of the boom so as to be swingable about a second horizontal pivot as a fulcrum, and a mechanical posture maintaining mechanism for maintaining the posture of the implement, regardless of swing displacement of the boom. The front loader is characterized in that the boom is formed in a smoothly-curved shape in which a longitudinal central side thereof is located above a center-to-center straight line connecting between the center of the first pivot and the center of the second pivot, and at least the longitudinal central side thereof curves. The front loader is also characterized in that the posture maintaining mechanism includes a swing link member having two free-end parts and disposed at a longitudinal center location of the boom so as to be swingable about a third horizontal pivot as a fulcrum, a base-end link member extending between the fixed bracket and one of the free-end parts of the swing link member, and a free-end link member that links the other free-end part of the swing link member to the swing bracket. The front loader is also characterized in that the swing link member is configured so that one of the free-end parts serves as an inner free-end part located inward in boom bending directions from an upper surface of the boom, and the other free-end part serves as an outer free-end part located outward in the boom bending directions from the upper surface of the boom. The front loader is also characterized in that the front loader further comprising a boom cylinder for driving the boom to swing. The front loader is also characterized in that the boom cylinder is bridged between the fixed bracket and the longitudinal central location of the boom, inward in boom bending directions of the boom. The front loader is also characterized in that the base-end link member is provided with a curved portion that is disposed between the boom and the boom cylinder, and curves to the boom side so that the curved portion bypasses, on the coupling end side to the inner free-end part, a coupling part between the boom and the boom cylinder.

According to non-limiting aspects of the above configuration, because the boom is formed in a smoothly-curved shape, the peak of the boom which is furthest from the center-to-center straight line can be lowered, as compared with a case where, for example, the boom is formed in the sharply-curved shape in which the longitudinal center side of the boom is located above the center-to-center straight line described above. Thereby, in the low position operating state, the area of the field of view of the operator who rides the vehicle body, which is interrupted by the boom, can be reduced.

Further, since the curved portion is provided to the base-end link member, the base-end link member can be disposed within a limited space between the boom and the boom cylinder, and, without contacting the coupling end side of the base-end link member to the inner free-end part of the swing link member with the coupling part between the boom and the boom cylinder, the base-end link member can extend the free-end side of the boom beyond the longitudinal center location of the boom where the coupling part is located. The base-end link member can be coupled to the inner free-end part of the swing link member at the free-end part of the boom.

In addition, the free-end part of the boom is the side which hangs over downwardly by a larger vertical distance than the base-end side of the boom in the low position operating state. Therefore, for example, as compared with a case where the swing link member is provided to the base-end side of the boom, the height of the swing link member can be lowered with respect to the boom in the low position operating state.

Thereby, in the low position operating state, the projecting amount of, for example, the swing link member which projects upwardly from the upper end of the boom in the downward line-of-sight direction when the operator who rides the vehicle body views, for example, the boom, can be reduced.

As a result, in the low position operating state, the area of the field of view of the operator who rides the vehicle body which is interrupted, for example, by the boom and the outer free-end part of the swing link member can be reduced. The visibility of the operating state from the vehicle body side in the low position operating state can be improved by the reduced amount of the interruption area, and the low position operation can be easily performed.

Therefore, the base-end link member can be disposed reasonably in the narrow space between the boom and the boom cylinder, and operability in the low position operating state can be improved.

Preferably, a boom cylinder for driving the boom to swing may be bridged between the fixed bracket and the longitudinal central location of the boom, inward in boom bending directions of the boom. The base-end link member may be provided with a curved portion that is disposed between the boom and the boom cylinder, and curves to the boom side so that the curved portion bypasses, on the coupling end side to the inner free-end part, a coupling part between the boom and the boom cylinder.

According to non-limiting aspects of the above configuration, the base-end link member is disposed within the limited space between the boom and the boom cylinder, and, without contacting the coupling end side of the base-end link member to the inner free-end part of the swing link member with the coupling part between the boom and the boom cylinder, the base-end link member can extend to the free-end side of the boom beyond the longitudinal center location of the boom where the coupling part is located. The base-end link member can be coupled to the inner free-end part of the swing link member in the free-end part of the boom.

In addition, the free-end part of the boom is the side which hangs over downwardly by a larger vertical distance than the base-end side of the boom in the low position operating state. Therefore, as the extending amount of the coupling end side of the base-end link member to the inner free-end part of the swing link member increases toward the free-end part of the boom, the height of the swing link member coupled to the extending end can be lowered with respect to the boom in the low position operating state.

Thereby, in the low position operating state, the projecting amount of, for example, the swing link member which projects upwardly from the upper end of the boom in the downward line-of-sight direction when the operator who rides the vehicle body views, for example, the boom, can be reduced.

As a result, in the low position operating state, the area of the field of view of the operator who rides the vehicle body which is interrupted, for example, by the boom and the outer free-end part of the swing link member can be reduced. The visibility of the operating state from the vehicle body side in the low position operating state can be improved by the reduced amount of the interruption area, and the low position operation can be easily performed.

Therefore, the base-end link member can be disposed reasonably within the narrow space between the boom and the boom cylinder, and operability in the low position operating state can be improved.

Preferably, the curved portion nay be curved to the boom side by a projecting amount of 8% to 15% of a separated distance between a coupling point of the base-end link member to the fixed bracket and a coupling point to the inner free-end part so that the curved portion bypasses the coupling part between the boom and the boom cylinder.

For example, if the curved portion of the base-end link member is curved to the boom side by a projecting amount smaller than 8% with respect to the separated distance described above, the possibility of the curved portion of the base-end link member contacting, for example, the coupling part between the boom and the boom cylinder increases at the time of driving the boom to swing, as the projecting amount becomes smaller.

On the contrary, if the curved portion of the base-end link member is curved to the boom side by a projecting amount larger than 15% with respect to the separated distance described above, it becomes more difficult to secure the necessary strength of the base-end link member, as the projecting amount becomes larger. In addition, the possibility of the curved portion of the base-end link member contacting the bottom of the boom at the time of driving the boom to swing increases. In order to avoid the contact, if the bottom of the boom is brought closer to the upper surface of the boom, a strength of the boom decreases, and it becomes difficult to secure the necessary strength of the boom.

Thus, in the above configuration, the curved portion is curved to the boom side by the projecting amount of 8% to 15% of the separated distance described above. Thereby, the curved portion of the base-end link member can be curved by the appropriate projecting amount by which the base-end link member can avoid the contact, for example, with the coupling part between the boom and the boom cylinder, without causing the inconveniences, such as the difficulties in securing the necessary strength of the boom or the base-end link member by excessively increasing the projecting amount.

Preferably, the swing link member may be configured in the maximally lowered state of the boom so that the coupling point of the inner free-end part and the base-end link member is located below an extended line of the boom cylinder.

According to non-limiting aspects of the above configuration, in the low position operating state in which the boom is maximally lowered, the swing link member can be disposed at the position of the boom closer to the free-end part so that the coupling point between the inner free-end part of the swing link member and the base-end link member is located below the extended line of the boom cylinder.

The free-end part of the boom is the side which hangs over downwardly by a larger vertical distance than the base-end side of the boom in the low position operating state. Therefore, the height of the swing link member can be lowered with respect to the boom in the low position operating state.

Thereby, in the low position operating state, the projecting amount of, for example, the swing link member which projects upwardly from the upper end of the boom in the downward line-of-sight direction when the operator who rides the vehicle body views, for example, the boom, can be even smaller. As a result, the area of the operator's field of view interrupted, for example, by the outer free-end part of the swing link member can be even smaller.

Therefore, operability in the low position operating state can be further improved.

Preferably, the base-end link member may include a reinforcing member at the curved portion.

According to non-limiting aspects of the above configuration, the strength in the curved portion of the base-end link member can be increased. As a result, deformation in the curved portion which may be caused when compressive load is applied to the base-end link member can be securely prevented.

Preferably, the reinforcing member may be formed in a tapered shape in which both longitudinal ends thereof are narrower continuously toward tips of the ends.

According to non-limiting aspects of the above configuration, it can be prevented that an abrupt change in the strength, for example, of the curved portion of the base-end link member, which is caused by providing the reinforcing member to the curved portion of the base-end link member.

Therefore, it can be avoided that, when the compressive load is applied to the base-end link member, the possibility of the deformation in the base-end link member which is caused by a stress concentration on part where the strength of the base-end link member changes abruptly.

Preferably, the curved portion may be formed in flat on the curve outer side.

According to non-limiting aspects of the above configuration, it can be easily avoided that the curve outer side of the curved portion contacts the boom at the time of driving the boom to swing, to interfere with the driving and swinging of the boom which is caused by providing the curved portion to the base-end link member.

Preferably, the boom cylinder may couple at an end on the cylinder tube side to the boom, and may include a joint for connecting a hydraulic hose in the boom coupling side end of the cylinder tube so as to oppose to the base-end link member. The curved portion may be curved to the boom side so as to bypass the joint as well as the coupling part between the boom and the boom cylinder.

According to non-limiting aspects of the above configuration, the base-end link member, as well as the joint provided to the cylinder tube of the boom cylinder and the hydraulic hose connected with the joint can be disposed in the limited space between the boom and the boom cylinder, and the possibility of the base-end link member contacting the joint and the hydraulic hose can be avoided.

Further, since it is not necessary to form a dedicated curved portion for avoiding contact with, for example, the joint, it is advantageous, for example, in formation and securing the strength of the base-end link member.

Preferably, the boom cylinder may include a joint for connecting a hydraulic hose in an end of the cylinder tube on the fixed bracket side, at a location opposing to the base-end link member. The base-end link member may have a less curved portion on the coupling end side to the fixed bracket. The less curved portion may curve gently to the boom side by a projecting amount smaller than the curved portion so that the less curved portion bypasses the joint on the fixed bracket side.

According to non-limiting aspects of the above configuration, the base-end link member, as well as the joint provided to the cylinder tube of the boom cylinder and the hydraulic hose connected with the joint can be disposed in the limited space between the boom and the boom cylinder, and the possibility of the base-end link member contacting the joint and the hydraulic hose can be avoided.

Further, since the deformation in the base-end link member required for avoiding the contact with, for example, the joint becomes smaller, the securing of the strength against the compressive load becomes easier. As a result, the configuration can be simplified by eliminating the reinforcing member, for example.

BRIEF DESCRIPTION OF THE DRAWINGS

The present disclosure is illustrated by way of example and not by way of limitation in the figures of the accompanying drawings, in which the like reference numerals indicate like elements, and in which.

DETAILED DESCRIPTION

First Embodiment

Hereinafter, there is described a first embodiment in which a front loader according to the present invention is mounted to a tractor. It should be noted, however, that the tractor is just one non-limiting example of a vehicle body which may utilize the front loader of the present invention.

Figure 1:
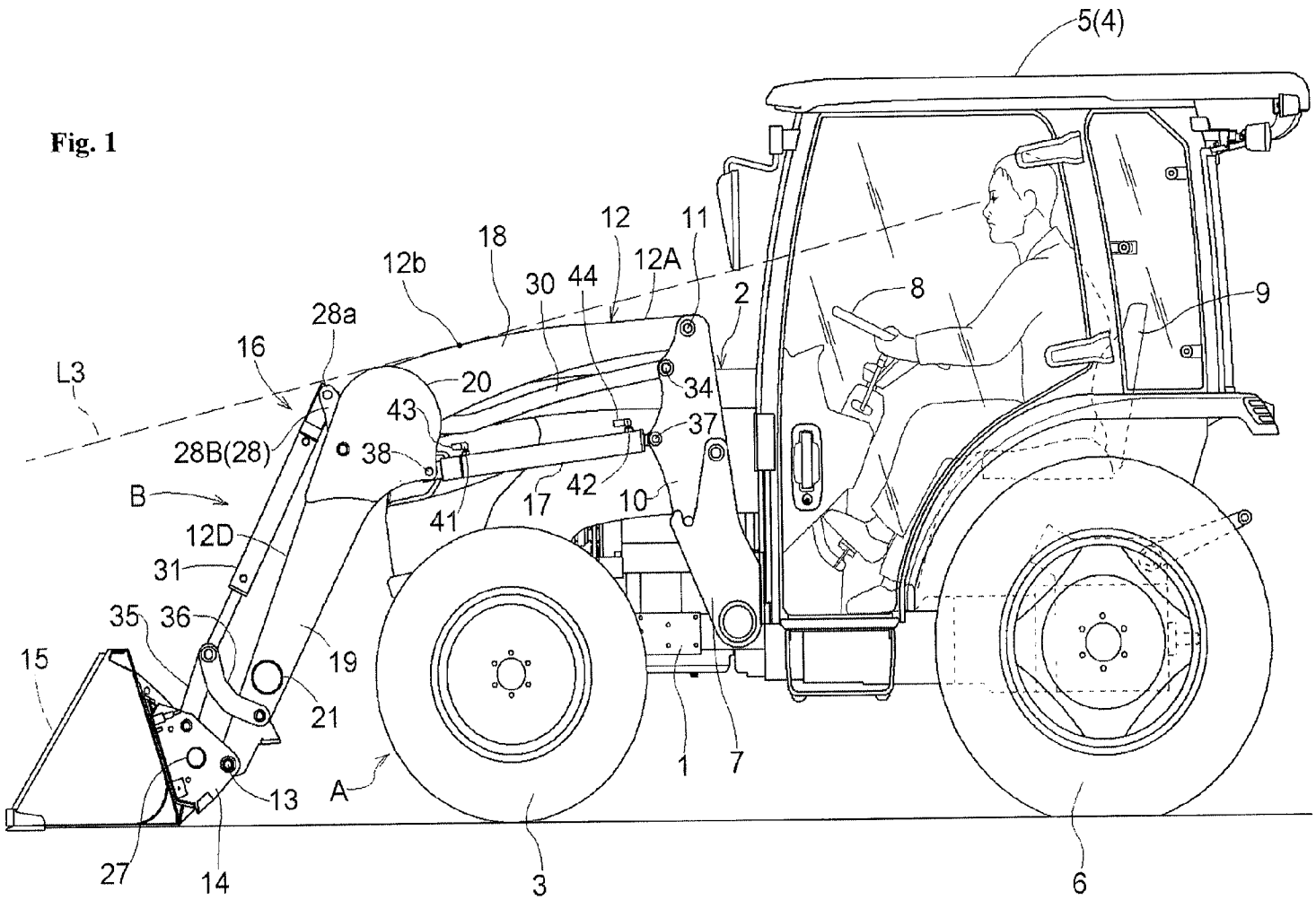
FIG. 1 shows a left side view of a tractor provided with a front loader.

As illustrated in FIG. 1, a vehicle body A can have the form of a tractor in this first embodiment that includes a power source part 2, e.g., engine, as well as left and right front wheels 3 arranged in a front part of a vehicle body frame 1. The tractor or vehicle body A also includes a cabin 5 forming a cockpit part 4 as well as left and right rear wheels 6 located in a rear part of the vehicle body frame 1. Left and right support brackets 7 are utilized for mounting a front loader B to a longitudinal intermediate part of the vehicle body frame 1. A steering wheel 8, an operator's seat 9, and other components etc. can also be arranged in the cockpit part 4.

Figure 2:
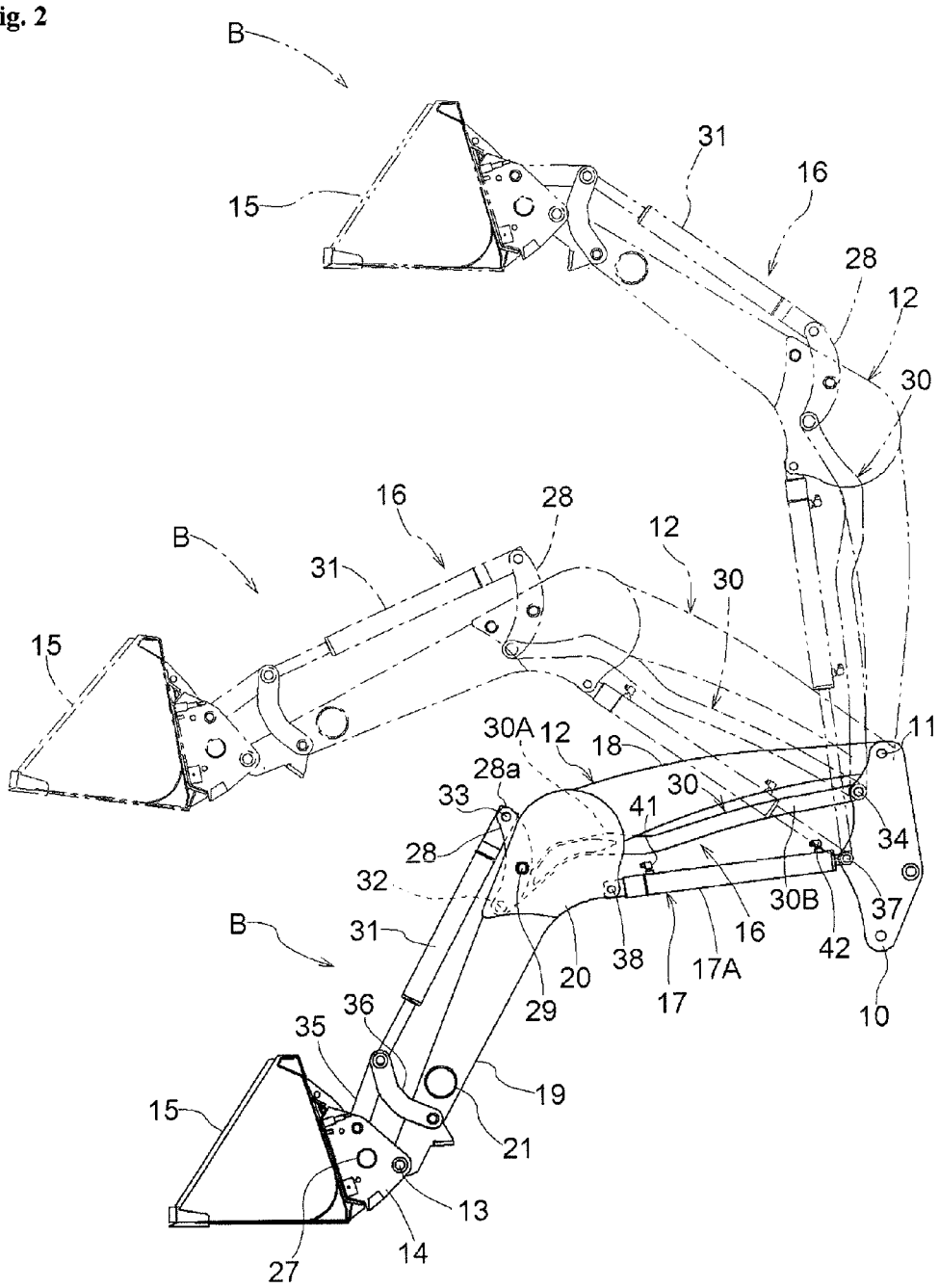
FIG. 2 shows a left side view of the front loader in various positions according to a first embodiment, illustrating operation of a posture maintaining mechanism interlocked with vertical swing of booms.
Figure 3:
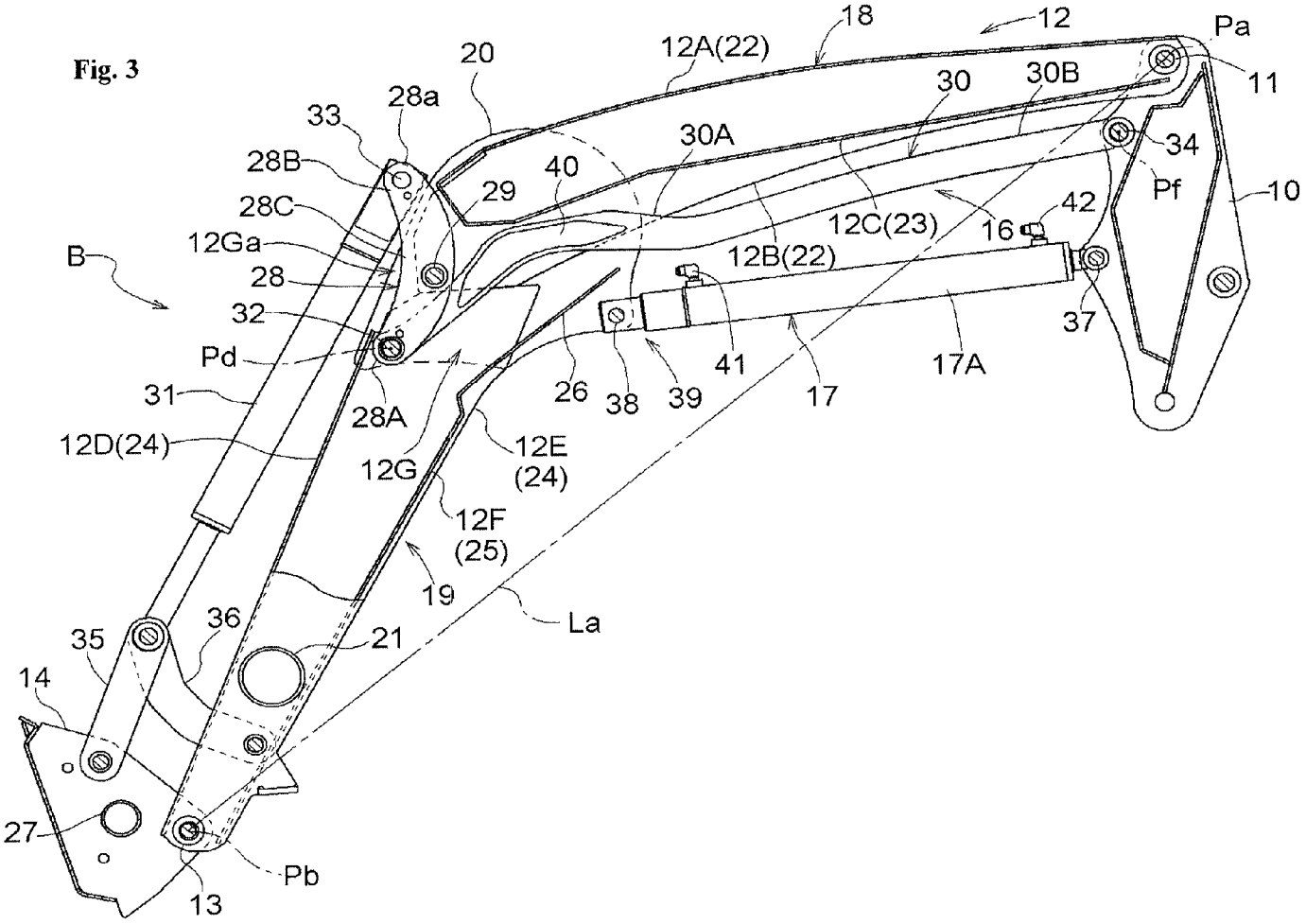
FIG. 3 shows a partial cross-sectional left side view illustrating a configuration of the front loader according to the first embodiment.
Figure 4:
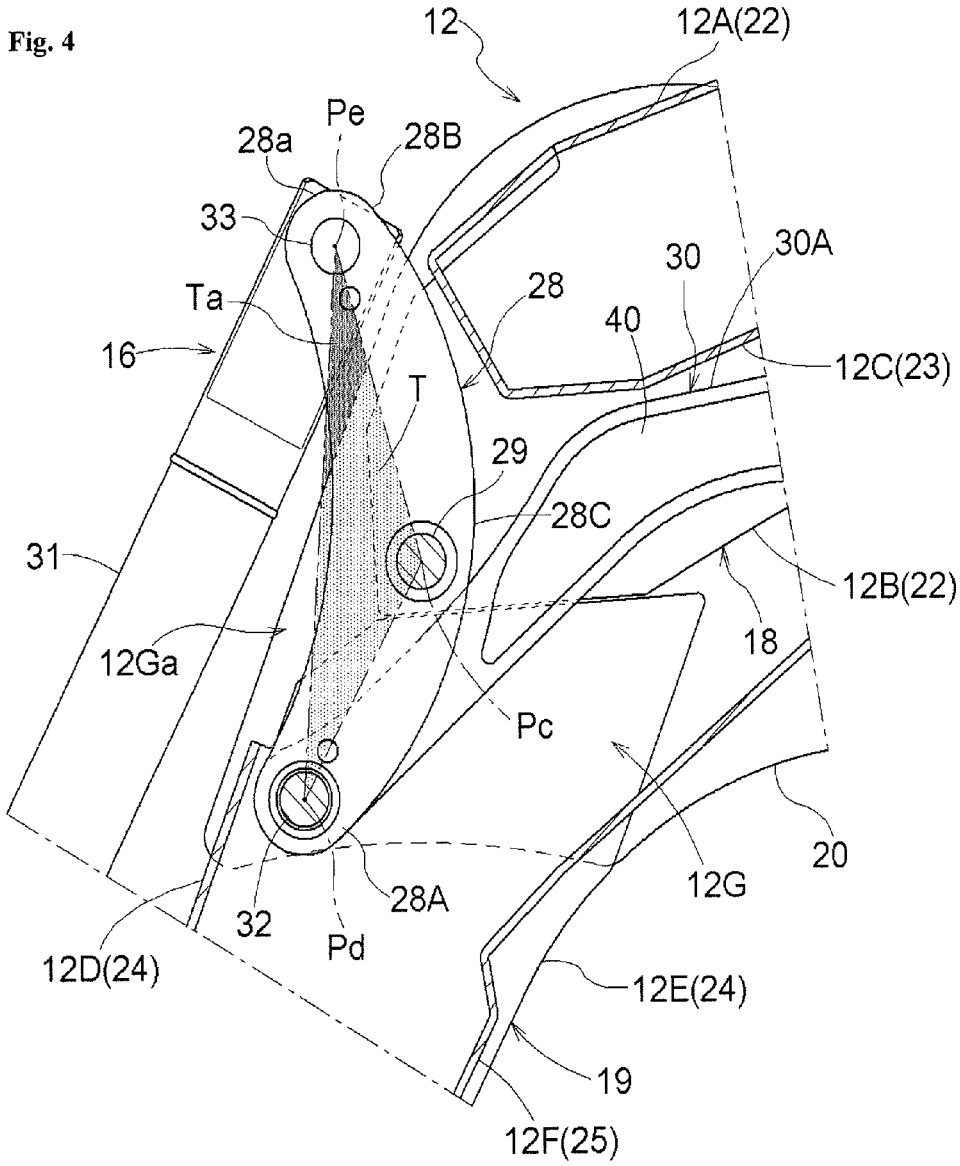
FIG. 4 shows a cross-sectional left side view illustrating structures around a swing link member of the front loader according to the first embodiment.

As illustrated in FIGS. 1-3, the front loader B illustrated in this first embodiment includes main components such as left and right fixed brackets 10, left and right booms 12, left and right swing brackets 14, a single implement 15 such as, e.g., a bucket, a mechanical posture maintaining mechanism 16, left and right boom cylinders 17. The left and right fixed brackets 10 are detachably mounted to the respective support brackets 7. The left and right booms 12 are coupled to the respective fixed brackets 10 so as to be swing able about a first pivot 11, i.e., up and down or vertically, which acts as a fulcrum extending in left-and-right directions. The left and right swing brackets 14 are coupled to respective free-end parts of the booms 12 so as to be swingable about a second pivot 13, which acts as a fulcrum extending in the left-and-right directions. The implement 15 is detachably coupled to the left and right swing brackets 14 so as to be swingable about the second pivot 13 integrally or along with the left and right swing brackets 14. The posture maintaining mechanism(s) 16 is/are configured to maintain the implement 15 at predetermined postures—regardless of the swing displacements of the left and right booms 12. The left and right boom cylinders 17 are hydraulic reciprocating cylinders, and are configured to drive or cause the respective booms 12 to swing about the first pivot axis 11.

Each fixed bracket 10 can be formed as a substantially U-shaped member (viewed in a plan view) and is configured to be fitted onto a corresponding coupling end, such as one of the booms 12.

Each boom 12 has main components such as a base-end boom body 18, a free-end boom body 19, and left and right reinforcement plates 20. The base-end boom body 18 is coupled at one end to one fixed bracket 10. The free-end boom body 19 is coupled at one end to one swing bracket 14. The other end of the base-end boom body 18 and the other end of the free-end boom body 19 are fixed, i.e., butt-welded, to each other, and the left and right reinforcement plates 20 are welded to these butted parts. By welding these components, each boom 12 is advantageously configured so as to have a smoothly-curved shape in which the central part thereof in the longitudinal directions is curved so as to be located above a center-to-center straight line La (see FIG. 3) which connects or extends between the center Pa of the first pivot 11 and the center Pb of the second pivot 13, with at least the central part being curved. The left and right free-end boom bodies 19 are coupled to each other via a coupling member 21 which is comprised of a tubular member, e.g., a round steel pipe, extending in the left-and-right directions. Utilizing the coupling member 21, the left and right booms 12 are configured to swing as an integral assembly about the first pivot 11—functioning as a fulcrum for the same.

In each boom 12, the base-end boom body 18 can be comprised of a first base-end member 22 and a second base-end member 23 which are welded together. The first base-end member 22 can be such as to form an upper surface 12A on the base-end side, and also left and right side surfaces 12B of the boom 12. The second base-end member 23 forms, for example, a lower surface 12C of the base-end side of the boom 12. The free-end boom body 19 is comprised of a first free-end member 24 and a second free-end member 25 which can be welded together. The first free-end member 24 forms an upper surface 12D and also left and right side surfaces 12E of the free-end part of the boom 12. The second free-end member 25 forms a lower surface 12F of the free-end part of the boom 12. An intermediate plate 26 can be welded to the left and right reinforcement plates 20. The intermediate plate 26 can be utilized to bridge the left and right reinforcement plates 20 so as to be continuous from the second free-end members 25. Each boom 12 is also configured to have a link space 12G in a center part or area (relative to a longitudinal direction). The link space 12G is formed so as to penetrate or be open to the upper surface 12A of the boom 12 on the base-end side and the upper surface 12D on the free-end side from between the second base-end members 23 and the intermediate plate 26.

The swing brackets 14 are coupled to each other via a coupling member 27 which can also be comprised of a round steel pipe extending in the left-and-right directions so that the swing brackets 14 swing as an integral assembly. The implement 15 is configured to be replaceable or interchangeable with any other implement suitable for operations to be performed, such as a bucket used for carrying soil and/or sand, and a roll grab used for carrying a roll bale, etc. FIG. 1 thus shows one non-limiting example where the bucket is mounted to the left and right swing brackets 14 and is used as the implement 15.

The posture maintaining mechanism(s) 16 has main component that include left and right swing link members 28, left and right base-end link members 30, and left and right drive cylinders 31. The left and right swing link members 28 have two free-end parts or sections 28A and 28B, respectively. A third pivot 29 is thus formed so as to extend in the left-and-right directions and this pivot 29 is disposed at the center in the longitudinal directions of the booms 12 so that the booms 12 are swing able about this third pivot 29 acting as a fulcrum. The left and right base-end link members 30 can be made from steel plates, and each base-end link member 30 is used to bridge the corresponding fixed bracket 10 and one of the free-end parts 28A of the corresponding swing link member 28. The left and right drive cylinders 31 are hydraulic reciprocating cylinders, and also serve as free-end link members linking the other free-end part 28B of the swing link member 28 and the swing bracket 14, respectively.

As illustrated in FIGS. 1-4, each swing link member 28 is configured so that one of the free-end parts 28A is coupled to the base-end link member 30 and becomes the "inner" free-end part 28A located inside the link space 12G at a location which is inward from the upper surfaces 12A and 12D of the corresponding boom 12 in boom bending directions. Further, the swing link member 28 is configured so that the other free-end part 28B is coupled to the drive cylinder 31 and becomes the "outer" free-end part 28B located outwardly from the corresponding upper surfaces 12A and 12D of the boom 12 in the boom bending directions. Each swing link member 28 is formed in a crescent shape so as to curve in a manner where the inner free-end part 28A and the outer free-end part 28B are located forward in the vehicle body longitudinal directions from a swing fulcrum part 28C provided with the third pivot 29. The inner free-end part 28A is coupled to one end of the base-end link member 30 via a first coupling shaft 32 extending in the left-and-right directions. The outer free-end part 28B is coupled to one end of the drive cylinder 31 via a second coupling shaft 33 extending in the left-and-right directions.

Each fixed bracket 10 includes a fourth pivot 34 extending in the left-and-right directions, below the first pivot 11 described above. Each base-end link member 30 bridges between the fourth corresponding pivot 34 of the corresponding fixed bracket 10 and the first coupling shaft 32 of the swing link member 28. As noted above, this occurs in an area which is inward in the boom bending directions from the upper surfaces 12A and 12D of the boom 12, and within the left and right width of the boom 12. Further, parts of the base-end link members 30 on the first coupling shafts side are configured to enter into the link space 12G after passing into and/or between the second base-end members 23 of the booms 12 and the intermediate plate 26.

The drive cylinders 31 are used to control the implement and drive or regulate the swing of the implement 15 which is mounted to the left and right swing brackets 14. One ends of each cylinder 31 is coupled to one outer free-end part 28B of a respective swing link member 28 via the second coupling shaft 33. The other end of each cylinder 31 is linked or coupled to a swing bracket 14 via a respective first link member 35. Members 35 are linked or coupled to the free-end parts of the booms 12 via second link members 36. The bucket 15 is configured to swing downwardly in a direction of a dumping posture, interlocking with an extending operation of the left and right drive cylinders 31, and to swing upwardly in a direction of a scooping-up posture, interlocking with a contracting operation of the left and right drive cylinders 31.

From the above-described configuration, it can be appreciated that the posture maintaining mechanism 16 is interlocked with the vertical swing of the left and right booms 12 to perform the extending-and-contracting and/or allow the front loader to assume various positions in operation. By the extending-and-contracting operations, one can see that when the left and right booms 12 reach a lower limit position, the left and right swing link members 28, base-end link members 30, and drive cylinders 31 assume a substantially Z-shaped configuration in a side view. On the other hand, when the left and right booms 12 reach an upper limit position, the left and right swing link members 28, base-end link members 30, and drive cylinders 31 assume a more substantially arch shaped configuration along the booms 12 in the side view. In addition, the left and right swing brackets 14 and the bucket 15 are generally maintained in predetermined postures (i.e., substantially a same posture) by the telescopic operation of the left and right drive cylinders 31 during the extending-and-contracting operation, regardless of the swing displacements of the left and right booms 12.

That is, the posture maintaining mechanism 16 is configured into a so-called mechanical link having a built-in Z-shaped boom in which the mechanism 16 is at least partially built into the left and right booms 12, and the left and right booms 12 utilize a substantially Z-shaped mechanism in side view when at the lower limit position.

Each fixed bracket 10 also includes a fifth pivot 37 extending in the left-and-right directions, which is below the fourth pivot 34 described above. Each boom 12 includes a sixth pivot 38 extending in the left-and-right directions, located below the intermediate plate 26 of the left and right reinforcement plates 20 located in the longitudinal center part. Each boom cylinder 17 is used to bridge the fifth pivot 37 of the corresponding fixed bracket 10 and the sixth pivot 38 of the corresponding boom 12. The boom cylinders 17 have the form of cylinder tubes 17A extending to the sixth pivot. In the inward area in the boom bending directions within the left and right width between the booms 12, the boom cylinders 17 are disposed at an inward location in the boom bending directions from the base-end link members 30, and at a height where the boom cylinders 17 do not interfere with the left and right front wheels 3 when the boom cylinders 17 are in a posture in which the boom cylinders 17 are oriented substantially along the base-end link members 30.

From the above configuration, it should be apparent that the front loader B can operate the left and right drive cylinders 31 to change the posture of the bucket 15 into the scooping-up posture, then operates the left and right boom cylinders 17 to swing the left and right booms 12 downwardly until the bucket 15 contacts or substantially contacts the ground surface to change the posture of the bucket 15 to the low position operating state in which material such as soil and/or sand (hereinafter, simple referred to as "soil and/or sand") can be scooped up into the bucket 15 while the front loader B is traveling forward. After scooping up material, e.g., soil and/or sand, in the bucket 15, the front loader B operates the left and right boom cylinders 17 to swing the left and right booms 12 upwardly to elevate the bucket 15 up to a predetermined height for a conveyance travel while the bucket 15 is maintained in the scooping-up posture by the posture maintaining mechanism 16. After reaching a discharge site, the front loader B operates the left and right boom cylinders 17 to swing the left and right booms 12 upwardly and/or downwardly so that the bucket 15 is located at a height suitable for discharge, and then operates the left and right drive cylinders 31 to change the posture of the bucket 15 into the dumping posture so that the soil and/or sand inside the bucket can be discharged to the predetermined discharge site, such as a loading platform of a truck.

Figure 5:
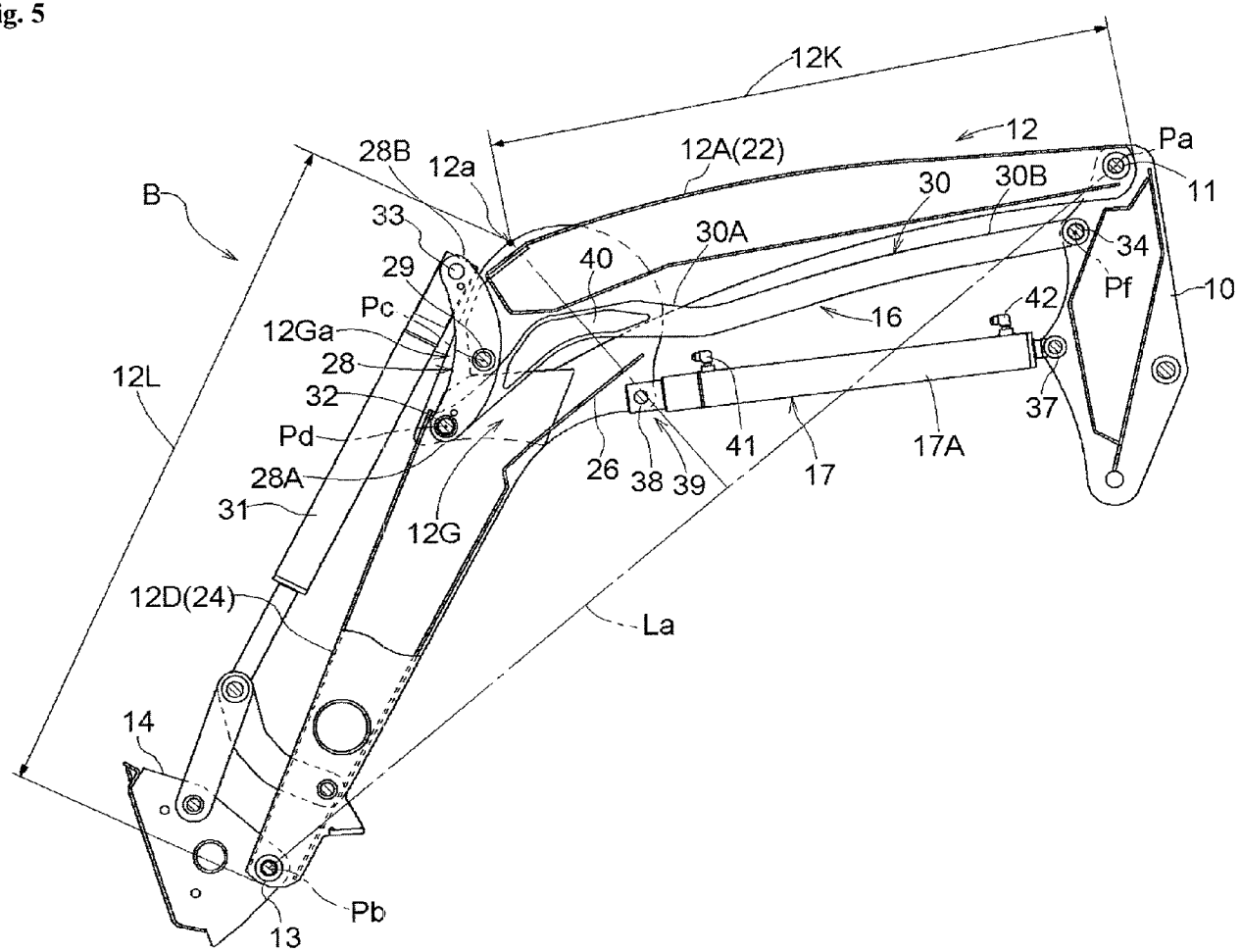
FIG. 5 shows a partial cross-sectional left side view of the front loader according to the first embodiment, illustrating a configuration in which a third pivot for the swing link member is mounted to a free-end boom part of the boom.

As illustrated in FIG. 5, each boom 12 includes a base-end boom part 12K and a free-end boom part 12L. The base-end boom part 12K is located on the first pivot side from a peak or point 12*a* of the boom 12 which is furthest from the center-to-center straight line La. The free-end boom part 12L is located on the second pivot side from the peak 12*a* of the boom 12. The third pivot 29 supporting the swing link members 28 is mounted to the free-end boom parts 12L. Each swing link member 28 is configured to be located on the second pivot side from the peak 12*a* of each boom 12.

Figure 6:
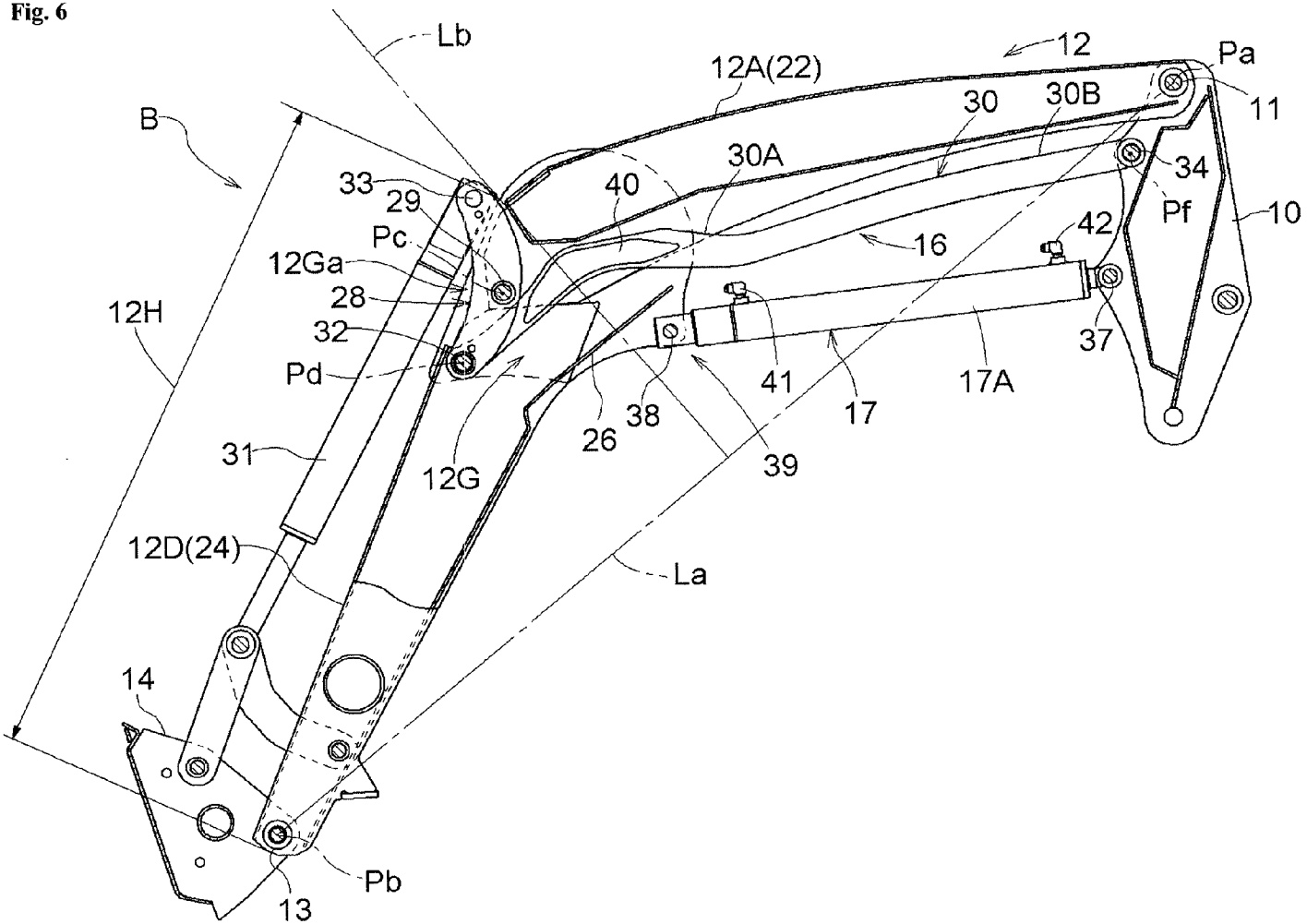
FIG. 6 shows a partial cross-sectional left side view of the front loader according to the first embodiment, illustrating the configuration in which the center of the third pivot for the swing link member is located within an area on the second pivot side including a boundary line which is perpendicular to a center-to-center straight line at ½ location of the center-to-center distance between the center of the first pivot and the center of the second pivot of the boom.

As illustrated in FIG. 6, the front loader B is configured such that the center Pc of each third pivot 29 that supports the left and right swing link members 28 is located within an area 12H on the second pivot side from a boundary line Lb which extends perpendicularly to the center-to-center straight line La from the ½ way location of the center-to-center distance between the center Pa of the first pivot 11 and the center Pb of the second pivot 13 of each boom 12, where the area 12H includes the boundary line Lb.

Figure 7:
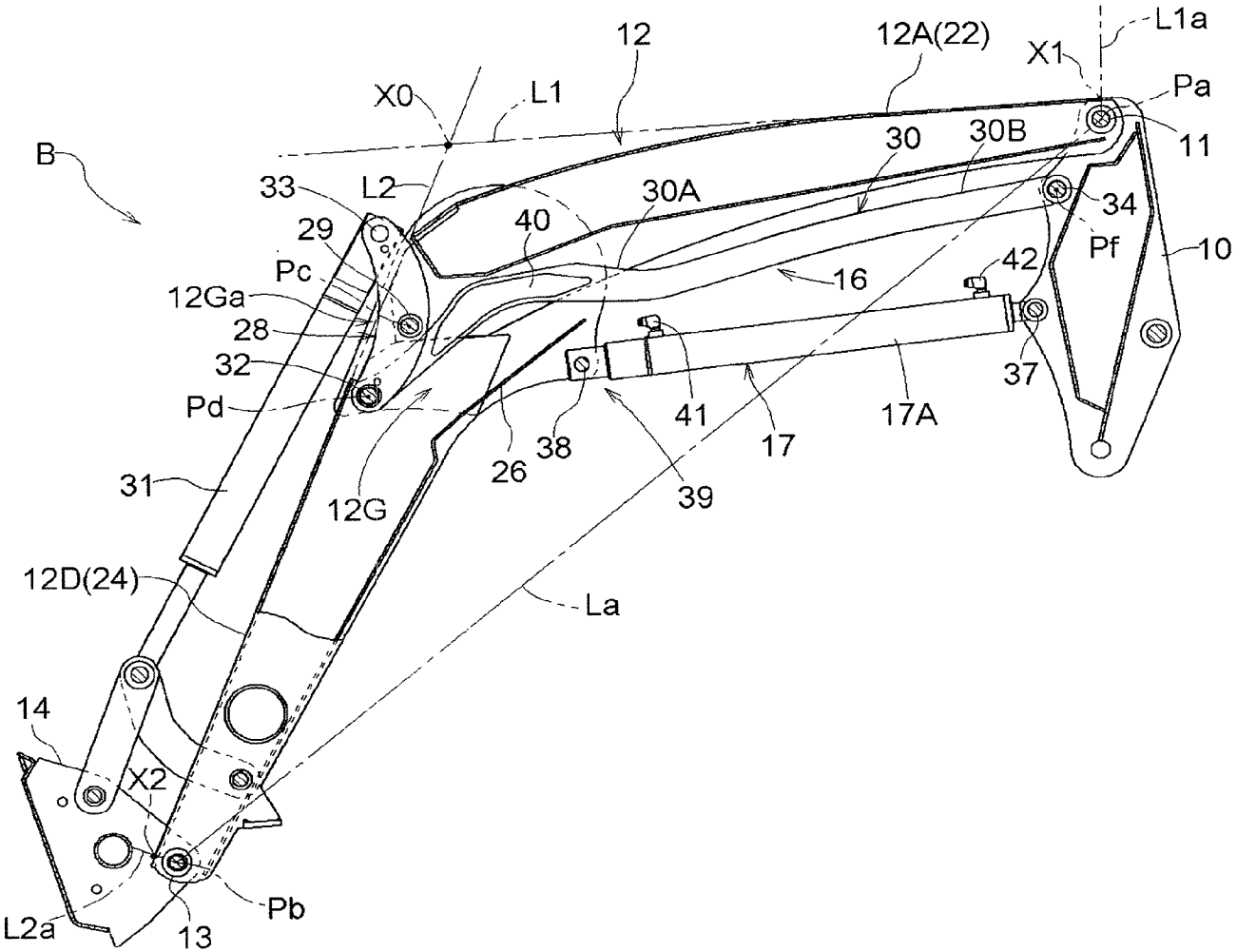
FIG. 7 shows a partial cross-sectional left side view of the front loader according to the first embodiment, illustrating the configuration in which, for example, the center of the third pivot for the swing link member is located on the second pivot side from an intersection between a first reference line from the first pivot side of the boom and a second reference line from the second pivot side.

As illustrated in FIG. 7, the front loader B is configured such that the center Pc of each third pivot 29 is located on the second pivot side from an intersection X0 between a first reference line L1 extending substantially from the corresponding first pivot side and a second reference line L2 extending substantially from the second pivot side of the boom 12. Note that the first reference line L1 is a perpendicular line to a first perpendicular line L1*a* at an intersection X1 between a first perpendicular line L1*a* which passes through the center Pa of the first pivot 11 and intersects perpendicularly to the upper surface 12A on the boom base-end side, and the upper surface 12A on the boom base-end side. Further, the second reference line L2 is a perpendicular line to a second perpendicular line L2*a* at an intersection X2 between a second perpendicular line L2*a* which passes through the center Pb of the second pivot 13 and intersects perpendicularly to the upper surface 12D on the boom free-end side, and the upper surface 12D on the boom free-end side.

As illustrated in FIGS. 3-7, each boom 12 is configured so that an opening 12Ga of the link space 12G on the boom upper surface side is located in a free-end boom part 12L.

As illustrated in FIGS. 2-7, each base-end link member 30 is disposed between the corresponding boom 12 and the corresponding boom cylinder 17. A curved portion 30A is provided on the first coupling shaft side which is a coupling end side with the inner free-end part 28A of the swing link member 28. Each curved portion 30A is curved to the boom side so that it bypasses a coupling part 39 between the corresponding boom 12 and the corresponding boom cylinder 17, as well as the intermediate plate 26 located above the coupling part 39. As described above, it is possible to prevent the first coupling shaft side of each base-end link member 30 from contacting the coupling part 39 between the boom 12 and the boom cylinder 17, and the intermediate plate 26 when each boom 12 is driven to swing, while disposing each boom cylinder 17 at the height where the boom cylinder 17 does not contact the corresponding front wheel 3. Further, the coupling position between each base-end link member 30 and the inner free-end part 28A of the swing link member 28 can be brought toward the corresponding second pivot side of the boom 12, while performing such contact prevention. As a result, each swing link member 28 can be readily disposed on the second pivot side of the corresponding boom 12.

As illustrated in FIGS. 1-7, each swing link member 28 is disposed on the second pivot side of the corresponding boom 12. In the low position operating state in which each boom 12 is lowered to the height where the bucket 15 contacts or substantially contacts the ground surface, the outer free-end part 28B is configured so that it projects forward in the vehicle body longitudinal directions from the opening 12Ga on the boom upper surface side in the link space 12G which is formed in the free-end boom part 12L of the corresponding boom 12. Further, as described above, each swing link member 28 is formed in the crescent shape. As described above, in each swing link member 28, the first coupling shaft 32 provided to the inner free-end part 28A, the second coupling shaft 33 provided to the outer free-end part 28B, and the third pivot 29 provided between the coupling shafts 32 and 33 are disposed in a triangular shape. Further, in the low position operating state described above, among an area T (see FIG. 4) of the triangle having the vertexes of the center Pc of the third pivot 29, the center Pd of the first coupling shaft 32, and the center Pe of the second coupling shaft 33 of each swing link member 28, a triangular area Ta on the second coupling shaft side having about 20% of the area T is configured to be exposed outside from the upper surface 12D on the free-end side of the corresponding boom 12. Further, in the low position operating state described above, an upper end 28*a* of the outer free-end part 28B of each swing link member 28, as well as the end of the drive cylinder 31 coupled to each outer free-end part 28B, are configured to be located below an upper end 12*b* of each boom 12 along a downward line of sight L3 when an vehicle operator who is sitting on the operator's seat 9 of the tractor A views each boom 12 (see FIG. 1).

According to the above configuration, at least in the low position operating state described above, the entire posture maintaining mechanism 16 of the front loader B is unseen from the operator who is sitting on the operator's seat 9 of the tractor A because it is hidden by the left and right fixed brackets 10 and the left and right booms 12.

Thus, for example, when the scooping-up operation which is one example of the low position operation in which the vehicle body travels forward in the state where the bucket 15 at the scooping-up posture is located at such a height that the bucket 15 touches or substantially touches the ground surface and scoops up the soil and/or sand by the bucket 15, the outer free-end part 28B of each swing link member 28 and each drive cylinder 31 of the posture maintaining mechanism 16 need not interrupt the field of view of the operator who is sitting on the operator's seat 9 of the tractor A. As a result, the visibility in the operating state from the cockpit part 4 in the low position operating state in which, for example, the scooping-up operation is performed, can be improved, and the low position operation, such as the scooping-up operation, becomes easier.

Figure 8:
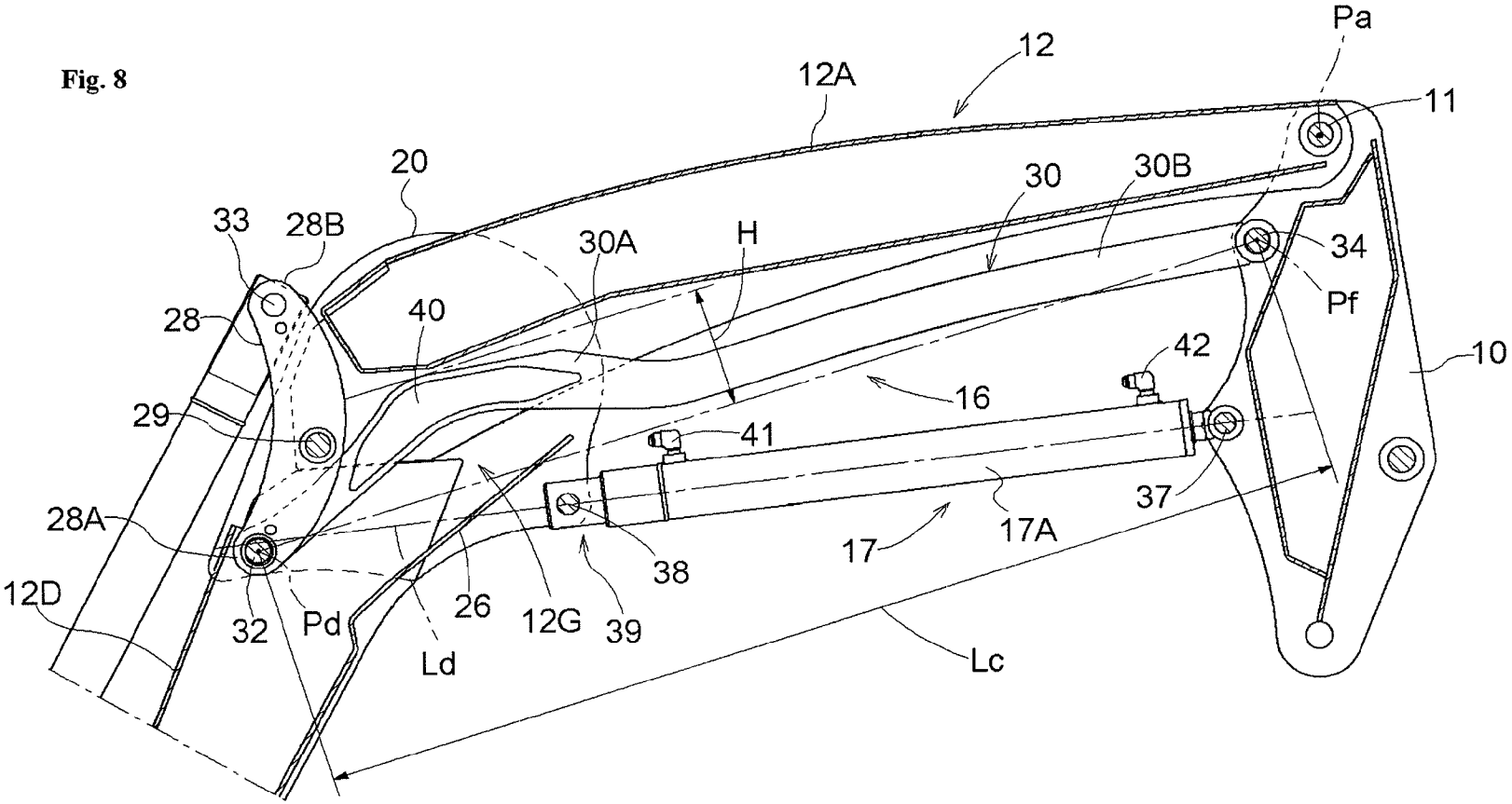
FIG. 8 shows a cross-sectional left side view illustrating the configuration of a curved portion of the base-end link member according to the first embodiment.
Figure 9:
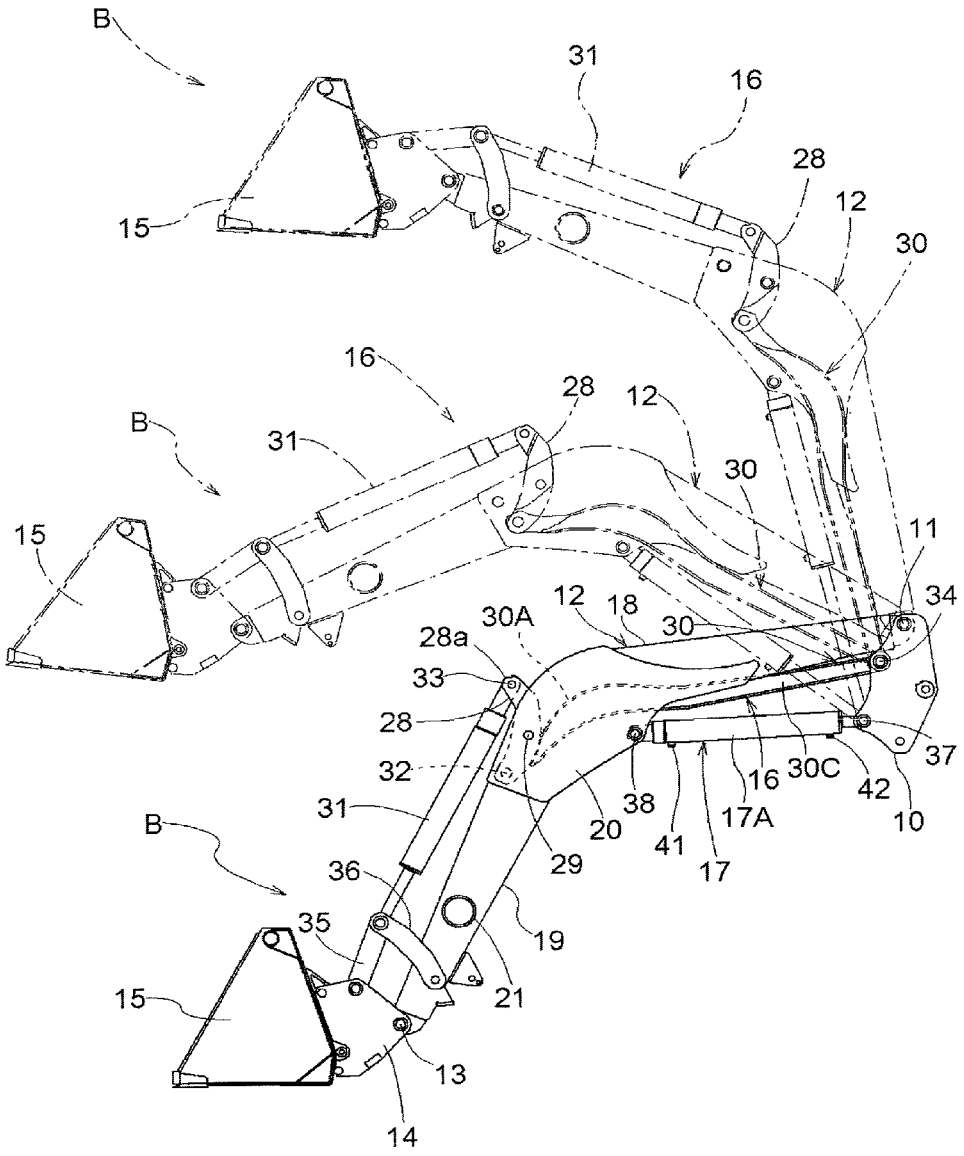
FIG. 9 shows a left side view of a front loader in various positions according to a second embodiment, illustrating operation of a posture maintaining mechanism interlocked with vertical swing of booms.

As illustrated in FIG. 8, in each base-end link member 30, the curved portion 30A is curved to the boom side by a projecting amount H which is 12% of a separated distance Lc between the center Pf of the fourth pivot 34 as the coupling point of the base-end link member 30 to the fixed bracket 10 and the center Pd of the first coupling shaft 32 as the coupling point of the swing link member 28 to the inner free-end part 28A so that the curved portion 30A bypasses the coupling part 39 between the boom 12 and the boom cylinder 17, and the intermediate plate 26.

Thereby, the curved portion 30A of each base-end link member 30 can be curved with an appropriate projecting amount such that the curved portion 30A does not contact, for example, the coupling part 39 between the boom 12 and the boom cylinder 17, and the intermediate plate 26.

As a result, since each boom cylinder 17 is disposed at such a height so that boom cylinder 17 does not contact the front wheel 3, even if the coupling part 39 between the boom 12 and the boom cylinder 17, and the intermediate plate 26 approach each base-end link member 30, each base-end link member 30 can avoid contact with the coupling part 39 between the boom 12 and the boom cylinder 17, and the intermediate plate 26 when each boom 12 is driven to swing.

As illustrated in FIG. 8, at least in the low position operating state in which each boom 12 becomes in a maximally lowered state, the posture maintaining mechanism 16 has each swing link member 28 disposed at the location on the free-end side from the longitudinal intermediate location of each boom 12 so that the coupling point Pd between each base-end link member 30 and the inner free-end part 28A of the swing link member 28 is located below an extending line Ld extending from each boom cylinder 17 and passing through the center of each boom cylinder 17.

Thereby, the height of each swing link member 28 with respect to each boom 12 can be lowered in the low position operating state. As a result, in the low position operating state, it can be easy to acquire a state in which, for example, the outer free-end part 28B of each swing link member 28 which projects from the upper surfaces 12A and 12D of each boom 12 is hidden by each boom 12 so that it is unseen from the operator who is sitting on the operator's seat 9 of the tractor A.

As illustrated in FIGS. 2-8, each base-end link member 30 includes a reinforcing member 40 on a side surface of the curved portion 30A. Thereby, the strength in the curved portion 30A of each base-end link member 30 can be increased, and deformation in the curved portion 30A which may be caused when a compressive load is applied to each base-end link member 30 can be securely prevented.

Each reinforcing member 40 is formed at both ends in longitudinal directions thereof into a tapered shape in which end sides are continuously narrower. Thereby, it can be prevented that the strength of this section changes sharply, for example, in the curved portion 30A of each base-end link member 30 by providing the reinforcing member 40 to the curved portion 30A of each base-end link member 30. As a result, when the compressive load is applied to each base-end link member 30, it can be avoided that stress is concentrated on part where the strength in each base-end link member 30 changes sharply and the base-end link member 30 deforms.

Each base-end link member 30 is formed into a flat shape in the curved portion 30A thereof on the curve outer side. Thus, since the curved portion 30A is formed in each base-end link member 30, one can easily avoid contact between the curve outer side of the curved portion 30A in each base-end link member 30 and the lower surface 12C of the corresponding boom 12 which could create problems regarding the swinging drive of each boom 12 when each boom 12 is driven to swing.

Each boom cylinder 17 is coupled at an end on the cylinder tube side to the corresponding booms 12. L-shaped joints 41 and 42 for connecting hydraulic hoses are provided to both end parts of each cylinder tube 17A, in locations opposite the base-end link member 30.

Each base-end link member 30 is curved to the boom side in the curved portion 30A thereof to bypass, for example, the coupling part 39 between the boom 12 and the boom cylinder 17, as well as the joint 41 provided to the coupling end of the cylinder tube 17A to the boom 12. Further, each base-end link member 30 has a less curved portion 30B on the fourth pivot side which is the coupling end side to the fixed bracket 10, by a projecting amount smaller than the curved portion 30A so that the less curved portion 30B curves gently to the boom side to bypass the joint 42 provided to an end of the cylinder tube 17A on the fixed bracket side.

Thus, the base-end link member 30 can avoid contact with the joints 41 and 42, and the hydraulic hoses 43 and 44, while disposing the base-end link member 30 as well as the joints 41 and 42 provided to the cylinder tube 17A of the boom cylinder 17, and the hydraulic hoses 43 and 44 connected with the joints 41 and 42, in the limited space between the corresponding boom 12 and the corresponding boom cylinder 17.

Further, on the first coupling shaft side of each base-end link member 30, since it is not necessary to form the dedicated curved portion for avoiding contact with the joint 41 and the hydraulic hose 43 of the cylinder tube 17A on the boom coupling end side, this configuration is advantageous in, for example, formation and securing the strength of each base-end link member 30.

Further, on the fourth pivot side of each base-end link member 30, since the amount of deformation of each base-end link member 30 required for avoiding contact with the joint 42 and the hydraulic hose 44 of the cylinder tube 17A on the fixed bracket side becomes smaller, securing the strength against the compressive load becomes easier. Thereby, the configuration can be simplified because the reinforcing member is not needed, for example.

Second Embodiment

Hereinafter, a second embodiment of the front loader according to the present invention is described as another non-limiting example of the form for carrying out the present invention based on the accompanying FIGS. 9-14.

The front loader B illustrated in this second embodiment includes improvements to the configurations of the booms 12 and the posture maintaining mechanism 16 in the front loader illustrated in the first embodiment described above. Therefore, only configurations different from the configurations of the boom 12 and the posture maintaining mechanism 16 which are described in the first embodiment will be described in more detail below, and explanation of other same configurations is omitted herein.

As illustrated in FIGS. 9-13, in each boom 12, the base-end boom body 18 is formed by welding the first base-end member 22, the second base-end member 23, etc. The first base-end member 22 forms the upper surface 12A and the left and right side surfaces 12B on the base-end side of the boom 12. The second base-end member 23 forms the lower surface 12C on the base-end side of the boom 12. The free-end boom body 19 is formed by welding the first free-end member 24, the second free-end member 25, etc. The first free-end member 24 forms the upper surface 12D and the left and right side surfaces 12E on the free-end side of the boom 12. The second free-end member 25 forms the lower surface 12F of the free-end side of the boom 12, etc. The intermediate plate 26 is welded to the left and right reinforcement plates 20. The intermediate plate 26 extends over the left and right reinforcement plates 20 so as to be substantially continuous from the lower surface 12F of the boom 12 which the second free-end member 25 forms.

In the posture maintaining mechanism 16, each swing link member 28 is formed in the substantially crescent shape so that the inner free-end part 28A and the outer free-end part 28B are located forward in the vehicle body directions from the swing fulcrum part 28C provided with the third pivot 29.

Each fixed bracket 10 includes the fifth pivot 37 extending in the left-and-right directions, below the fourth pivot 34 described above. Each boom 12 includes the sixth pivot 38 extending in the left-and-right directions, near the intermediate plate 26 on the first pivot side from the intermediate plate 26 of the left and right reinforcement plates 20 located in the longitudinal center part. Each boom cylinder 17 is bridged between the fifth corresponding pivot 37 of the corresponding fixed bracket 10 and the sixth pivot 38 of the corresponding boom 12 so that the cylinder tube 17A is located on the sixth pivot side.

Each swing link member 28 is disposed on the second pivot side of the corresponding boom 12. In the low position operating state in which each boom 12 is lowered to the height where the bucket 15 contacts or substantially contacts the ground surface, in the state where the outer free-end part 28B is located below the peak 12*a* which is separated most from the center-to-center straight line La of the boom 12, the outer free-end part 28B is configured to project forward in the vehicle body longitudinal directions from the opening 12Ga on the boom upper surface side of the link space 12G formed in the free-end boom part 12L of the corresponding boom 12. Thus, in the low position operating state described above, the upper end 28*a* of the outer free-end part 28B of each swing link member 28, as well as the end part of the drive cylinder 31 coupled to each outer free-end part 28B, are configured to be located below the upper end 12*b* of each boom 12 in a direction of a downward line of sight when the operator who is sitting on the operator's seat 9 of the tractor A views each boom 12.

With the above configuration, at least in the low position operating state described above, the entire posture maintaining mechanism 16 provided on the front loader B is configured to be unseen from the operator who is sitting on the operator's seat 9 of the tractor A because it is hidden by the left and right fixed brackets 10 and the left and right booms 12.

Thus, for example, when the scooping-up operation which is one example of the low position operation is performed, in which the vehicle body travels forward to scoop up the soil and/or sand by the bucket 15 while the bucket 15 at the scooping-up posture is located at the height where the bucket 15 contacts or substantially contacts the ground surface, it can be avoided that, for example, the outer free-end part 28B of each swing link member 28 and each drive cylinder 31 of the posture maintaining mechanism 16 interrupt the field of view of the operator who is sitting on the operator's seat 9 of the tractor A. As a result, it is possible to improve the visibility in the operating state from the cockpit part 4 in the low position operating state in which, for example, the scooping-up operation is performed, and the low position operation, such as the scooping-up operation, becomes easy to perform.

As illustrated in FIGS. 9-13, at least in the low position operating state in which each boom 12 becomes in the maximally lowered state, the posture maintaining mechanism 16 has each swing link member 28 disposed at the location on the free-end side from the longitudinal intermediate location of each boom 12 so that the third pivot 29 that supports each swing link member 28 is located near the extending line Ld from each boom cylinder 17 passing through the center of each boom cylinder 17.

Each base-end link member 30 is made from a steel plate, and a reinforcing member 45 made from a steel plate is welded to a side face of the base-end link member 30. The reinforcing member 45 has a length extending from a location nearby the coupling point between the base-end link member 30 and the fixed bracket 10 to the coupling point between the base-end link member 30 and the inner free-end part 28A of the swing link member 28. The reinforcing member 45 is formed in substantially the same shape as the base-end link member 30 in the side view. Thus, each base-end link member 30 has a high strength substantially throughout the length thereof.

Further, in each base-end link member 30, the curved portion 30A is curved to the boom side to bypass the coupling part 39 between the boom 12 and the boom cylinder 17, and the intermediate plate 26, by a projecting amount H of 16% with respect to the separated distance Lc between the center Pf of the fourth pivot 34 as the coupling point to the fixed bracket 10 of the base-end link member 30 and the center Pd of the first coupling shaft 32 as the coupling point to the inner free-end part 28A of the swing link member 28.

Thus, the center Pg of each sixth pivot 38 which couples the corresponding boom 12 to the corresponding boom cylinder 17 is configured, regardless of the upward and downward swing of each boom 12, to be located between a connecting line Le which linearly connects the center Pf of the fourth pivot 34 of the corresponding fixed bracket 10 with the center Pd of the first coupling shaft 32 of the swing link member 28, and each base-end link member 30.

Therefore, it can be avoided that each base-end link member 30 contacts the coupling part 39 between the boom 12 and the boom cylinder 17 when each boom 12 is driven to swing, while disposing each swing link member 28 lower with respect to each boom 12 in the low position operating state and disposing each boom cylinder 17 at the height where the boom cylinder 17 does not contact the front wheel 3.

As illustrated in FIGS. 10-13, in each base-end link member 30, the curved portion 30A is formed to have a larger vertical width as it goes toward the longitudinal central part of the base-end link member 30, in other words, as the separated distance from the connecting line Le described above becomes larger.

Thereby, the strength in the curved portion 30A of each base-end link member 30 can be increased. As a result, deformation in the curved portion 30A which may be caused when compressive load is applied to each base-end link member 30 can be securely prevented.

Further, it can be prevented that the strength changes sharply in the curved portion 30A of each base-end link member 30. As a result, when the compressive load is applied to each base-end link member 30, it can be avoided that stress concentrates on the part where the strength in each base-end link member 30 changes sharply and the base-end link member 30 deforms.

As illustrated in FIGS. 10-13, each base-end link member 30 is formed so that the fourth pivot side extending from the curved portion 30A to the fourth pivot 34 of the fixed bracket 10 serves as a linear portion 30C extending substantially along a straight line. Thereby, it is advantageous, for example, in formation and securing the strength of each base-end link member 30.

Each boom cylinder 17 includes the L-shaped joints 41 and 42 for connecting the hydraulic hoses which are provided to both ends of those cylinder tubes 17A on the side away from the base-end link member 30. Thereby, it is avoidable at the time of vertically driving each boom 12 that each base-end link member 30 connects the joints 41 and 42 provided to the cylinder tube 17A of each boom cylinder 17, and the hydraulic hoses 43 and 44 connected with the joints 41 and 42.

As illustrated in FIGS. 10-13, each base-end link member 30 is disposed at the location inward in the boom bending directions with respect to each boom 12 so that a length part thereof at least longer than ½ of the entire length from the first coupling shaft 32 to the fourth pivot 34 is located so as to be exposed outside the corresponding boom 12.

Specifically, each base-end link member 30 is configured so that at least a lower edge portion of the linear portions 30C opposing to the boom cylinder 17 is located so as to be exposed outside the boom 12 in the section inward in the boom bending directions with respect to each boom 12.

Figure 10:
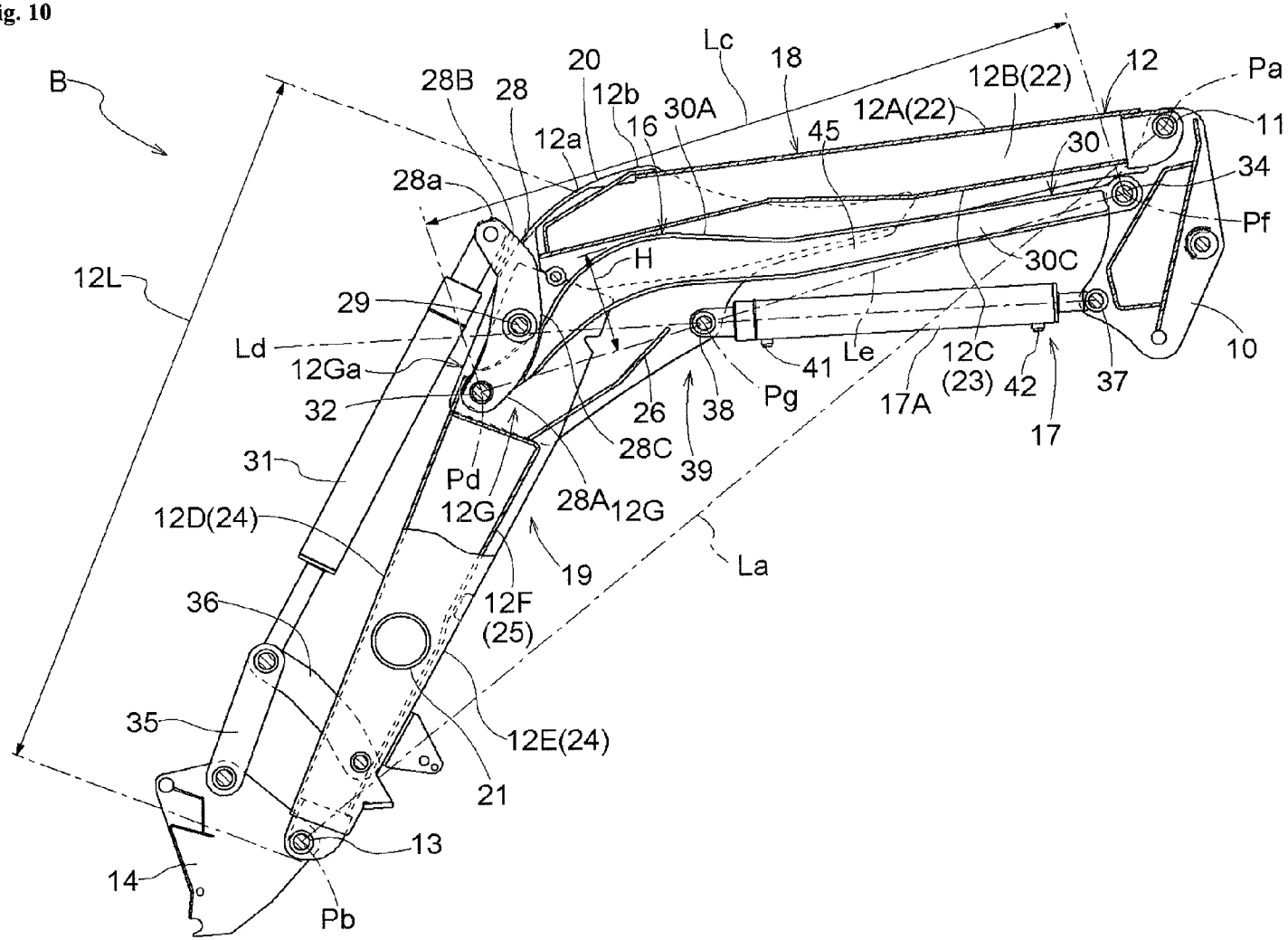
FIG. 10 shows a partial cross-sectional left side view of the front loader according to the second embodiment, illustrating a maximally lowered state of the booms.
Figure 12:
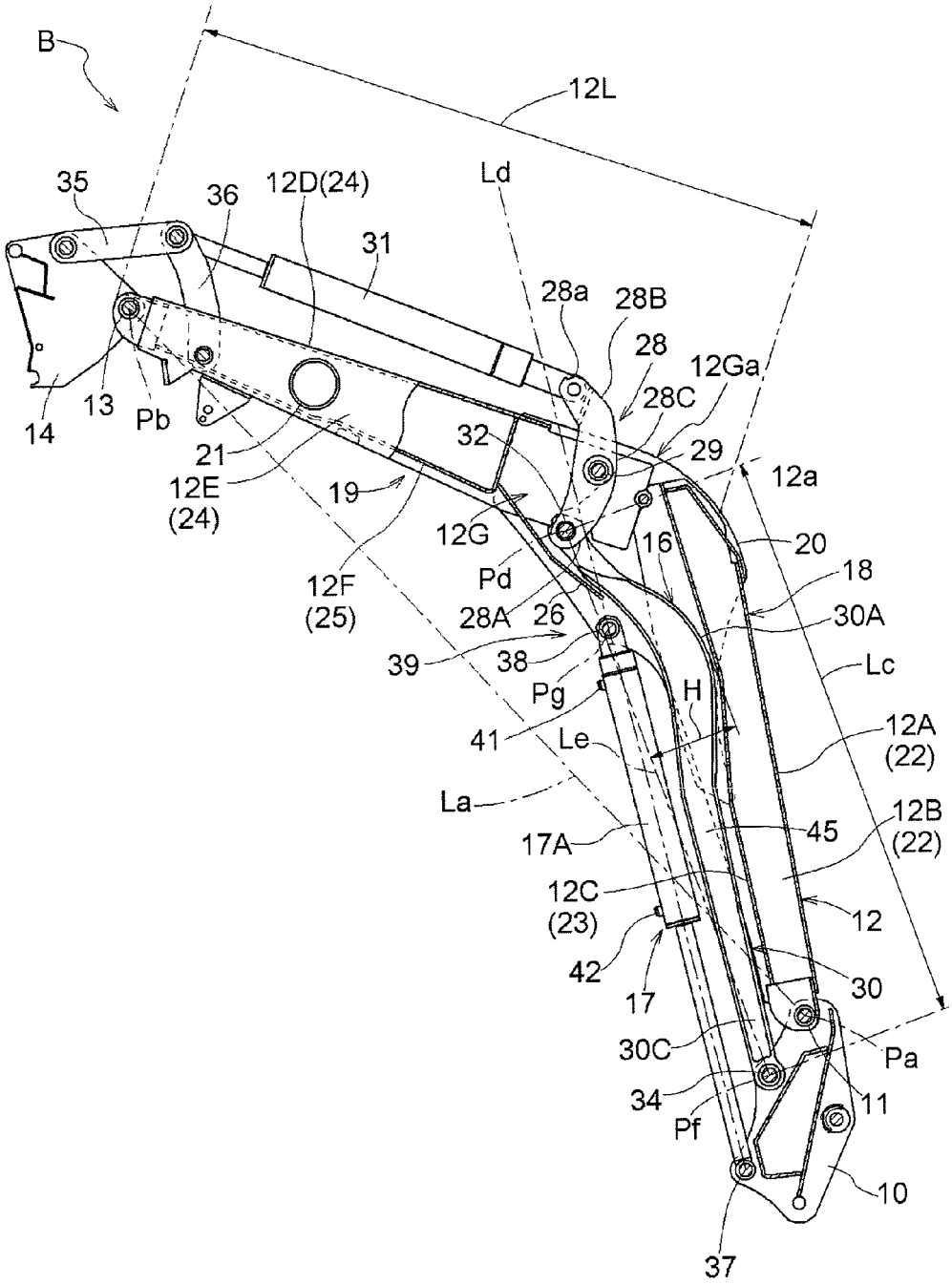
FIG. 12 shows a partial cross-sectional left side view of the front loader according to the second embodiment, illustrating a maximally elevated state of the booms.
Figure 13:
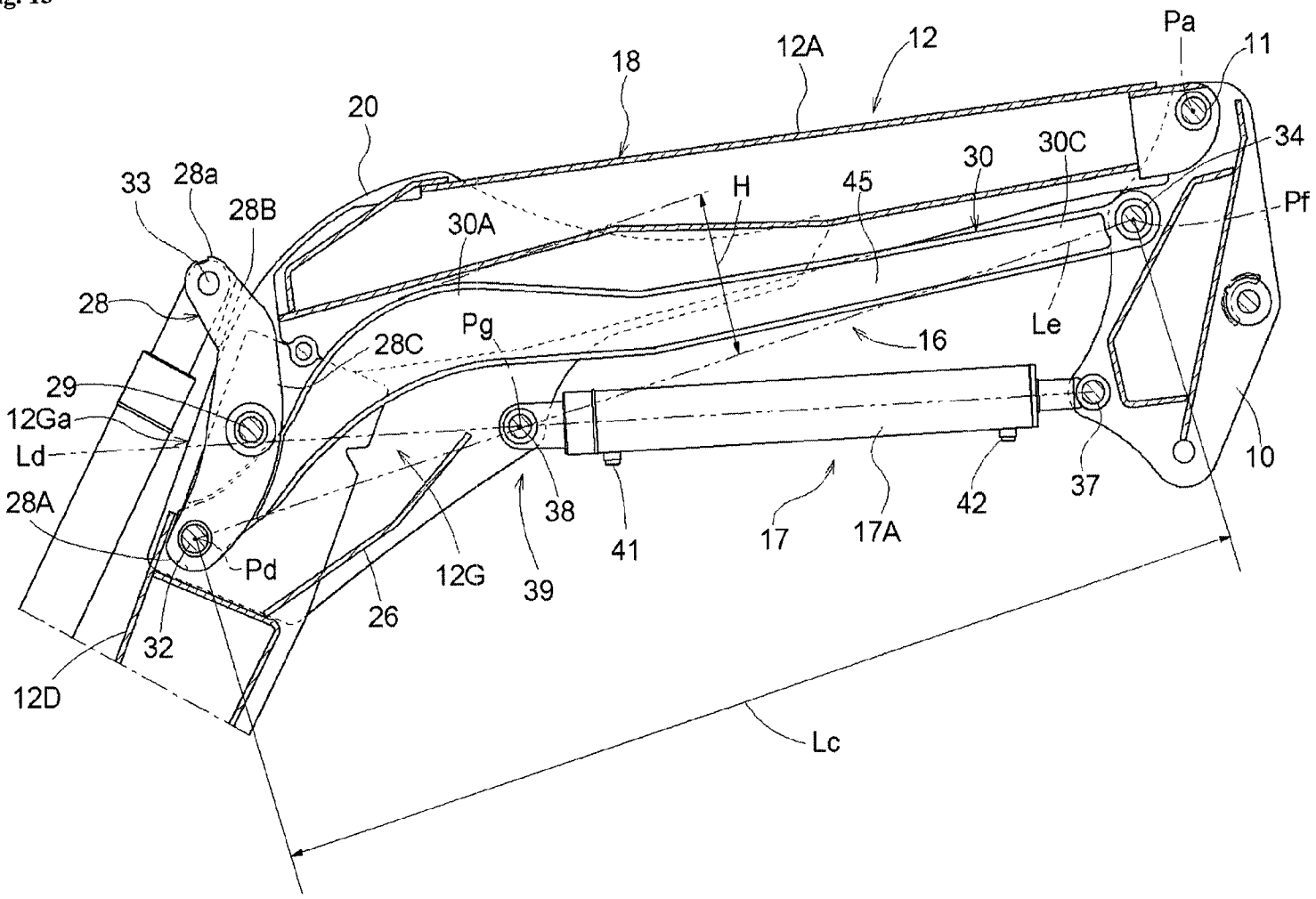
FIG. 13 shows a cross-sectional left side view illustrating the configuration of a curved portion of the base-end link member according to the second embodiment.

Further, in the maximally lowered state and the maximally elevated state of each boom 12, it is configured so that at least a length part longer than ½ of the entire length of each base-end link member 30 from the first coupling shaft 32 to the fourth pivot 34 is located so as to be exposed outside the corresponding boom 12 (see FIGS. 10 and 12).

Figure 11:
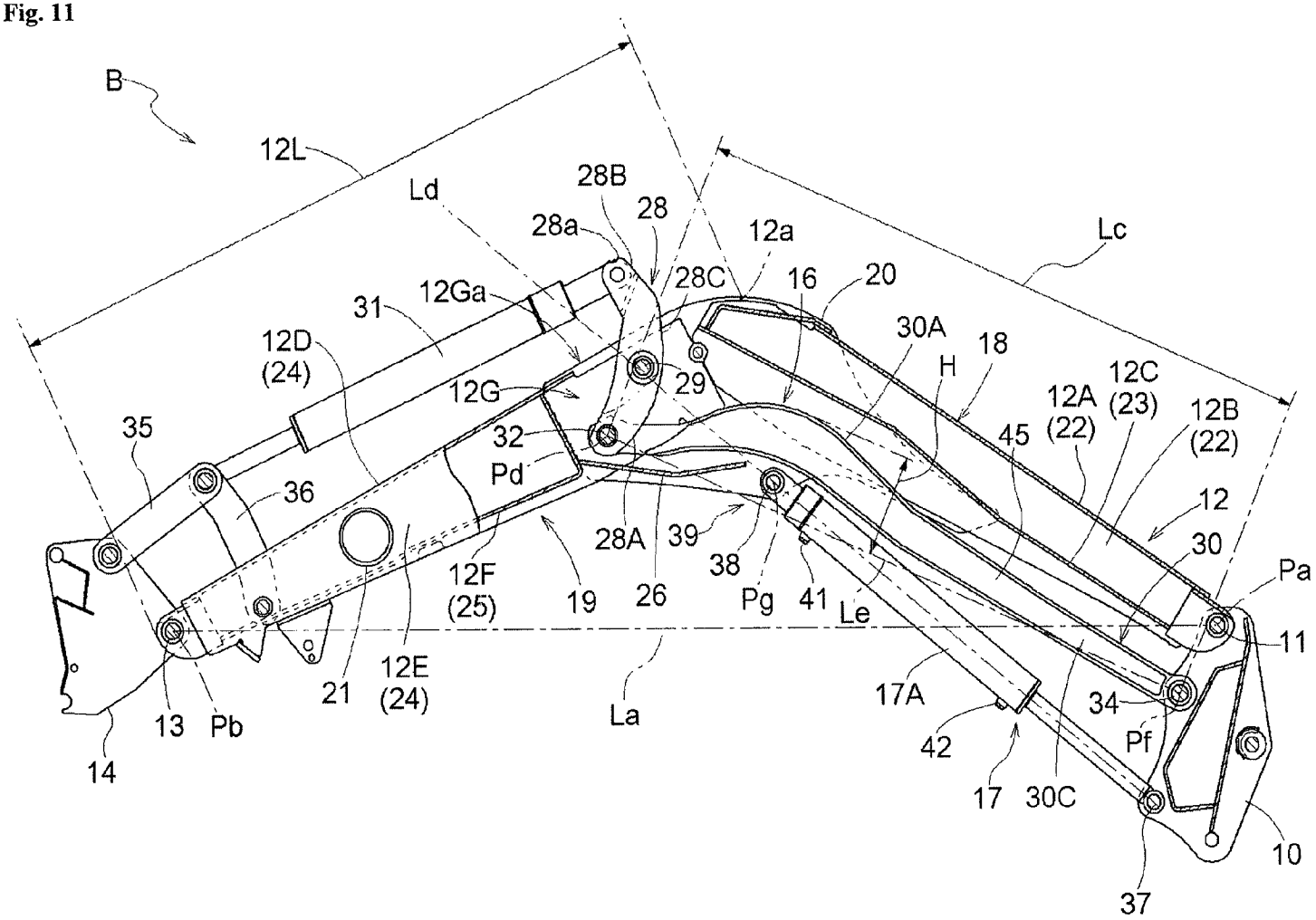
FIG. 11 shows a partial cross-sectional left side view of the front loader according to the second embodiment, illustrating a horizontal state of the booms.

Further, in a horizontal state of each boom 12 in which the center-to-center straight line La described above becomes horizontal, each base-end link member 30 is configured so that at least a length part longer than ⅔ of the entire length of the base-end link member 30 from the first coupling shaft 32 to the fourth pivot 34 is located so as to be exposed outside the corresponding boom 12 (see FIG. 11).

Other Embodiments

The front loader B can also include one or more of the following fundamental elements (A) to (I) as described in the above embodiments:

(A) The free-end boom part 12L of the boom 12 is provided with the third pivot 29 for the swing link member;

(B) The center Pc of the third pivot 29 for the swing link member is configured to be located within the area 12H of the boom 12 on the second pivot side;

(C) The swing link member 28 is disposed on the second pivot side of the boom 12 from the peak 12*a;*

(D) In the low position operating state, the upper end of the outer free-end part 28B of the swing link member 28 is configured to be located below the upper end 12*b* of the boom 12;

(E) The center Pc of the third pivot 29 for the swing link member is configured to be located on the second pivot side from the intersection X0 between the first reference line L1 and the second reference line L2;

(F) In the low position operating state, the 25%-or-less area Ta of the entire triangle area T of the swing link member 28 on the second coupling shaft side is configured so as to be exposed outside the boom 12;

(G) In the low position operating state, the outer free-end part 28B of the swing link member 28 is configured so as to project forward in the vehicle body longitudinal directions from the free-end boom portion 12L of the boom 12;

(H) In the low position operating state, the outer free-end part 28B of the swing link member 28 is configured to be located below the peak 12*a* which is most separated from the center-to-center straight line La of the boom 12; and (I) The curved portion 30A is provided to the base-end link member 30 of the posture maintaining mechanism 16.

Figure 14:
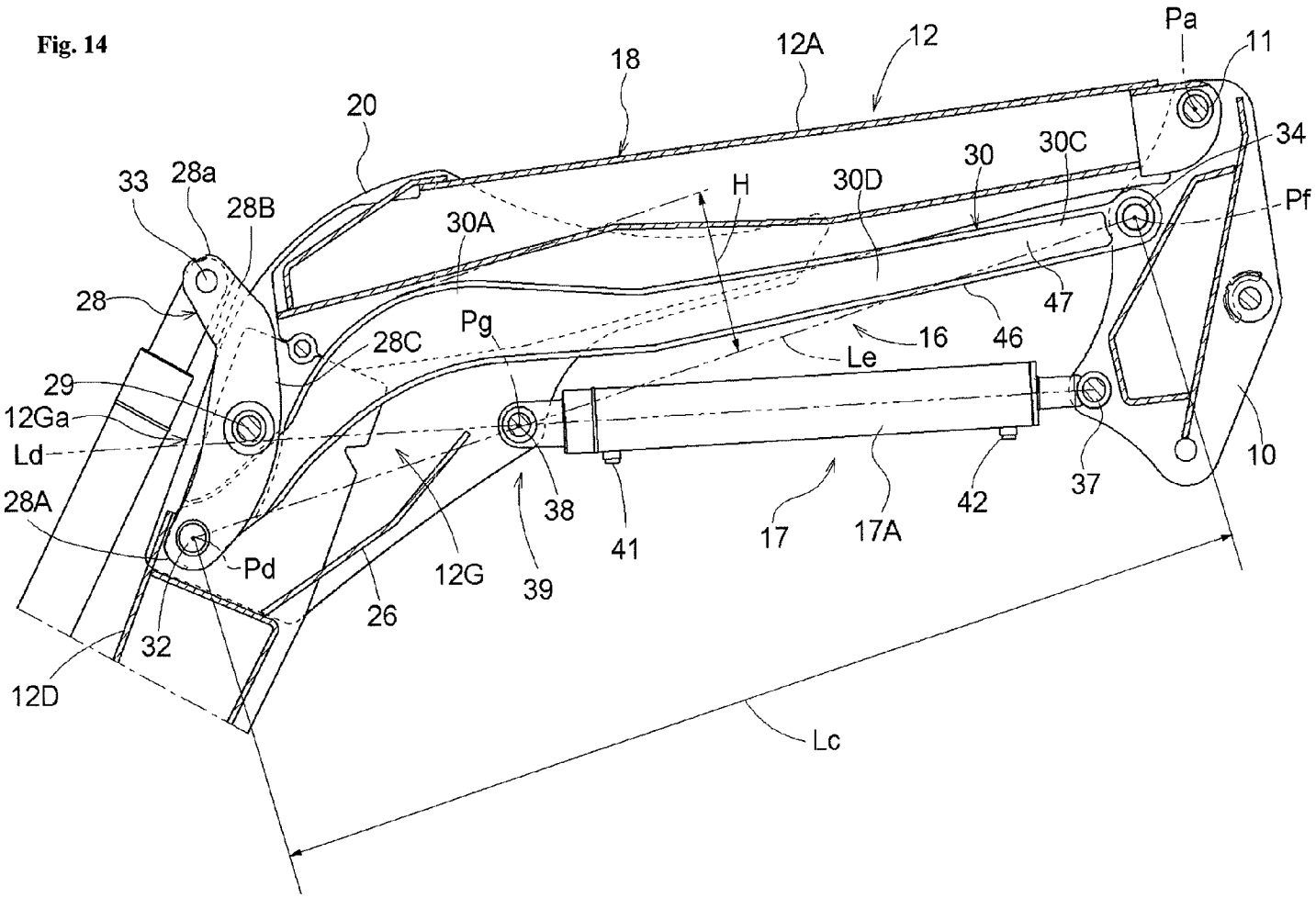
FIG. 14 shows a cross-sectional left side view illustrating the configuration of a base-end link member according to another embodiment.

If at least any one of the above elements is satisfied, in the low position operating state, as long as the projecting amount of, for example, the swing link member 28 which projects upwardly from the upper end 12*b* of the boom 12 can be reduced, and as long as the visibility of the operating state from the vehicle body side in the low position operating state can be improved, various changes, for example, illustrated in the following items (1) to (20) may be made:

(1) The front loader B may be detachably mounted to the vehicle body A other than the tractor, such as, a conveyance vehicle. Alternatively, the front loader B may be fixedly and detachably mounted to the vehicle body A;

(2) The front loader B may be configured so that the implement 15 is unable to be replaced to other kind of implements, with respect to free-end parts or swing brackets 14 of the booms 12;

(3) The front loader B may be comprised of a single fixed bracket 10, a single boom 12, and a single swing bracket 14;

(4) The boom 12 may be formed into a V-shape where a longitudinal central part thereof is located above the center-to-center straight line La which connects between the center Pa of the first pivot 11 and the center Pb of the second pivot 13. Alternatively, the boom 12 may be formed by welding three or more boom bodies, such as a base-end boom body, an intermediate boom body, a free-end boom body. Alternatively, the boom 12 may be formed by bending a single boom body;

(5) The boom 12 may be configured to be entirely curved in an arch shape;

(6) The boom 12 may not be provided with the intermediate plate 26;

(7) The boom 12 may be configured so that the implement 15 is directly mounted to the second pivots 13 of the free-end parts. Alternatively, the boom 12 may be configured so that the implement 15 is mounted to the swing brackets 14 after the swing brackets 14 are mounted to the second pivots 13 of the free-end parts. That is, the front loader B according to the present invention may be configured so that the implement 15 is swingably mounted to the free-end parts of the booms 12 about the second horizontal pivots 13 as the fulcrums, without the swing brackets 14 intervened, or may be configured so that the implement 15 is swingably mounted to the free-end parts of the booms 12 about the second horizontal pivots 13 as the fulcrums, via the swing brackets 14. The implement cited in the appended claims encompasses both types of the implement 15, such as the single implement 15 and the implement 15 mounted to the swing brackets 14;

(8) Various changes may be made to the cross-sectional shape of the boom 12 as long as the shape of the boom 12 has a strength more than the necessary minimum;

(9) The posture maintaining mechanism 16 may be comprised of a single swing link member 28, a single base-end link member 30, and a single free-end link member 31. Alternatively, a hydraulic single-action drive cylinder 31 or a non-telescopic link member may be adopted as the free-end link member 31;

(10) The swing link member 28 of the posture maintaining mechanism 16 may be formed in a curved shape where the inner free-end part 28A and the outer free-end part 28B are located rearward in the vehicle body longitudinal directions from the swing fulcrum part 28C. Alternatively, the swing link member 28 may be formed in a shape where the inner free-end part 28A, the outer free-end part 28B, and the swing fulcrum part 28C are aligned on a straight line;

(11) The swing link member 28 of the posture maintaining mechanism 16 may be configured so that, in the maximally lowered state of the boom 12, the coupling point Pd between the inner free-end part 28A and the base-end link member 30 is located on an extended line from the boom cylinder 17. Alternatively, if the projecting amount of, for example, the swing link member 28 which projects upwardly from the upper end 12*b* of the boom 12 in the low position operating state can be reduced, and if the visibility of the operating state from the vehicle body side in the low position operating state can be improved, the coupling point Pd between the inner free-end part 28A and the base-end link member 30 may be configured to be located above the extending line Ld of the boom cylinder 17 also in the maximally lowered state of the boom 12;

(12) As illustrated in FIG. 14, the base-end link member 30 of the posture maintaining mechanism 16 may be formed by welding a first member 46 made from a steel plate coupled to the fixed bracket 10 and a second member 47 made from a steel plate coupled to the inner free-end part 28A of the swing link member 28. Note that, in such a configuration, the first member 46 has a length extending from the fixed bracket 10 to a location nearby the inner free-end part 28A of the swing link member 28. The second member 47 has a length extending from the inner free-end part 28A of the swing link member 28 to a location nearby the fixed bracket 10. Further, the first member 46 and the second member 47 are formed in substantially the same shape in the side view from their extending-out sides. Thus, the extended side of the first member 46 is welded to the extended side of the second member 47 to configure the base-end link member 30 so that the base-end link member 30 is provided with a reinforcing part 30D having a length extending from a location nearby the coupling part to the fixed bracket 10 to a location nearby the coupling part to the inner free-end part 28A of the swing link member 28 so as to overlap with the first and second members. Therefore, each base-end link member 30 is configured to have high strength substantially throughout the length;

(13) If the base-end link member 30 itself of the posture maintaining mechanism 16 has a strength which can secure the necessary strength as the base-end link member 30, the reinforcing members 40 and 45, and the reinforcing part 30D may be unnecessary as constituent members of the base-end link member 30. Specifically, the base-end link member 30 itself may be configured to have the high strength by adopting, for example, a steel pipe member, as the constituent member thereof;

(14) The projecting amount H of the curved portion 30A of the base-end link member 30 in the posture maintaining mechanism 16 illustrated in the first embodiment can be varied within a range of 8% to 15% of the separated distance Lc between the coupling point Pf of the base-end link member 30 to the fixed bracket 10 and the coupling point Pd to the inner free-end part 28A. Note that if the curved portion of the base-end link member 30 illustrated in the first embodiment is curved to the boom side by the projecting amount of 8% to 15% of the separated distance Lc, inconveniences, such as difficulties in securing the necessary strength of the boom and the base-end link member, which may be invited when the projecting amount is excessively large, or contacting of the base-end link member with the coupling part between the boom and the boom cylinder, which may be invited when the projecting amount is excessively small, can be avoided;

(15) The projecting amount H of the curved portion 30A of the base-end link member 30 in the posture maintaining mechanism 16 illustrated in the second embodiment can be varied within a range of 13% to 19% of the separated distance Lc between the coupling point Pf of the base-end link member 30 to the fixed bracket 10 and the coupling point Pd to the inner free-end part 28A. Note that if the curved portion of the base-end link member 30 illustrated in the second embodiment is curved to the boom side by the projecting amount of 13% to 19% of the separated distance Lc, inconveniences, such as difficulties in securing the necessary strength of the boom and the base-end link member, which may be invited when the projecting amount is excessively large, or contacting of the base-end link member with the coupling part between the boom and the boom cylinder, which may be invited when the projecting amount is excessively small, can be avoided;

(16) Various changes may be made to the shape of the curved portion 30A of the base-end link member 30 according to the configuration of the boom 12, the coupling location of the boom 12 and the boom cylinder 17, etc.;

(17) The base-end link member 30 of the posture maintaining mechanism 16 may not have the less curved portion 30B;

(18) A single-action hydraulic cylinder may be adopted as the boom cylinder 17, for example;

(19) The boom cylinder 17 may be provided with the joints 41 and 42 for connecting the hydraulic hoses in the side part of the cylinder tube 17A;

(20) The fixed bracket 10 may be configured to be dividable into a vehicle body part and front loader part;

(21) Each base-end link member 30 may be configured so that, in the maximally lowered state and in the maximally elevated state of each boom 12, at least ½ of the length of each base-end link member 30 from the first coupling shaft 32 to the fourth pivot 34 is located so as to be exposed outside the corresponding boom 12;

(22) Each base-end link member 30 may be configured so that the length exposed outside from the link space 12G of the corresponding boom 12 is longer than at least ½ of the length of each base-end link member 30 from the first coupling shaft 32 to the fourth pivot 34; and

(23) Each base-end link member 30 may be configured so that the length exposed outside from the link space 12G of the corresponding boom 12 is longer than the length located inside the link space 12G.

The present invention is applicable to the front loader provided with the mechanical posture maintaining mechanisms for maintaining the posture of the implement, regardless of the swing displacements of the booms.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed:

1. A front loader, comprising:

a fixed bracket mountable to a vehicle body;

a boom mounted to the fixed bracket so as to be vertically swingable about a first horizontal pivot;

an implement mounted to a free-end part of the boom so as to be swingable about a second horizontal pivot; and a mechanical posture maintaining mechanism for substantially maintaining a posture of the implement one of: regardless of swing displacement of the boom; and/or between different swing displacement positions of the boom, wherein:

the boom has a curved shape in which a longitudinal central side of the boom is located above a center-to-center straight line extending between a center of the first pivot and a center of the second pivot;

the posture maintaining mechanism includes:

a swing link member having two free-end parts and disposed in an area of a longitudinal center location of the boom so as to be swingable about a third horizontal pivot;

a base-end link member extending between the fixed bracket and one of the free-end parts of the swing link member; and a free-end link member that links the other free-end part of the swing link member to the implement, the swing link member is configured so that one of the free-end parts serves as an inner free-end part located inward in a boom bending direction from an upper surface of the boom, and the other free-end part serves as an outer free-end part located outward in the boom bending direction from the upper surface of the boom, and the boom includes:

a base-end boom part located on the first pivot side from a peak that is furthest from the center-to-center straight line; and a free-end boom part located on the second pivot side from the peak, and the free-end boom part being provided with the third pivot;

a boom cylinder connected to the fixed bracket and to a point located behind the swing link member; and the swing link member is configured so that a triangular shape area is formed by:

the third horizontal pivot;

a first coupling shaft coupling the free-end part to the base-end link member; and a second coupling shaft coupling the other free-end part to the free-end link member.

2. The front loader of claim 1, wherein a center of the third pivot is configured to be located within an area on the second pivot side from a boundary line including the boundary line, the boundary line extending perpendicularly from the center-to-center straight line at substantially a ½ location of a center-to-center distance between the center of the first pivot and the center of the second pivot of the boom.

3. The front loader of claim 1, wherein, in a low position operating state in which the boom is lowered to a height where the implement contacts or substantially contacts a ground surface, an upper end of the outer free-end part is configured to be located below an upper end of the boom in a downward operator line-of-sight direction.

4. The front loader of claim 1, wherein:

a center of the third pivot is configured to be located on the second pivot side from an intersection between a first reference line from the first pivot side of the boom and a second reference line from the second pivot side of the boom, the first reference line is a line perpendicular to a first perpendicular line at an intersection between the first perpendicular line and the upper surface of the boom, the first perpendicular line extends through the center of the first pivot and intersects perpendicularly to the upper surface of the boom, and the second reference line is a line perpendicular to a second perpendicular line at an intersection between the second perpendicular line and the upper surface of the boom, the second perpendicular line extends through the center of the second pivot and intersects perpendicularly to the upper surface of the boom.

5. The front loader of claim 1, wherein, in a low position operating state in which the boom is lowered to a height where the implement contacts or substantially contacts the ground surface, the outer free-end part is configured to be located below the peak.

6. The front loader of claim 1, wherein, the base-end link member includes a curved portion that is disposed between the boom and the boom cylinder, and curves so that the curved portion bypasses, on the coupling end side to the inner free-end part, a coupling part arranged between the boom and the boom cylinder.

7. A front loader, comprising:

a fixed bracket mountable to a vehicle body;

a boom mounted to the fixed bracket so as to be vertically swingable about a first horizontal pivot;

an implement mounted to a free-end part of the boom so as to be swingable about a second horizontal pivot; and a mechanical posture maintaining mechanism for maintaining a posture of the implement at least one of:

regardless of swing displacement of the boom; and/or between different swing displacement positions of the boom, wherein:

the boom has a curved shape in which a longitudinal central side of the boom is located above a center-to-center straight line connecting between the center of the first pivot and the center of the second pivot, the posture maintaining mechanism includes:

a swing link member having two free-end parts and disposed at a longitudinal center location of the boom so as to be swingable about a third horizontal pivot;

a base-end link member extending between the fixed bracket and one of the free-end parts of the swing link member; and a free-end link member that links the other free-end part of the swing link member to the implement;

the swing link member is configured so that one of the free-end parts serves as an inner free-end part located inward in a boom bending direction from an upper surface of the boom, and the other free-end part serves as an outer free-end part located outward in the boom bending direction from the upper surface of the boom;

the swing link member is configured so that a triangular shape area is formed by:

the third horizontal pivot;

a first coupling shaft coupling the inner free-end part to the base-end link member; and a second coupling shaft coupling the outer free-end part to the free-end link member; and in a low position operating state in which the boom is lowered to a height where the implement contacts or substantially contacts a ground surface, an area of about 25% or less is defined on the second coupling shaft side in relation to the triangular shaped area, and a center of the second coupling shaft is exposed outside the boom, wherein a first free-end part pivot and a second free-end part pivot are more forward than the third horizontal pivot.

8. The front loader of claim 7, wherein the boom is provided with a base-end boom part located on the first pivot side from a peak that is furthest from the center-to-center straight line and a free-end boom part located on the second pivot side from the peak, and the free-end boom part being provided with the third horizontal pivot.

9. The front loader of claim 7, wherein the center of the third horizontal pivot is configured to be located within an area on the second pivot side from a boundary line including the boundary line, the boundary line extending perpendicularly from the center-to-center straight line at substantially a ½ location of a center-to-center distance between the center of the first pivot and the center of the second pivot of the boom.

10. The front loader of claim 7, wherein, in a low position operating state in which the boom is lowered to a height where the implement contacts or substantially contacts the ground surface, an upper end of the outer free-end part is configured to be located below an upper end of the boom in a downward line-of-sight direction when an operator sitting on an operator's seat of the vehicle body views the boom.

11. The front loader of claim 7, wherein:

a center of the third pivot is configured to be located on the second pivot side from an intersection between a first reference line from the first pivot side of the boom and a second reference line from the second pivot side of the boom, the first reference line is a line perpendicular to a first perpendicular line at an intersection between the first perpendicular line and the upper surface of the boom, the first perpendicular line extends through the center of the first pivot and intersects perpendicularly to the upper surface of the boom, and the second reference line is a line perpendicular to a second perpendicular line at an intersection between the second perpendicular line and the upper surface of the boom, the second perpendicular line extends through the center of the second pivot and intersects perpendicularly to the upper surface of the boom.

12. The front loader of claim 7, wherein:

the boom is provided with a base-end boom part located on the first pivot side from a peak that is furthest from the center-to-center straight line and a free-end boom part located on the second pivot side from the peak, and in a low position operating state in which the boom is lowered to a height where the implement contacts or substantially contacts the ground surface, the outer free-end part is configured to be located below the peak.

13. The front loader of claim 7, further comprising a boom cylinder for driving the swing displacement of the boom, wherein, the boom cylinder extends between the fixed bracket and the longitudinal central location of the boom and is located inward in the boom bending direction of the boom, and the base-end link member includes a curved portion that is disposed between the boom and the boom cylinder, and curves so that the curved portion bypasses, on the coupling end side to the inner free-end part, a coupling part between the boom and the boom cylinder;

a boom cylinder connected to the fixed bracket and to a point located behind the swing link member; and wherein a first free-end part pivot and a second free-end part pivot are more forward than the third horizontal pivot.

14. A front loader, comprising:

a fixed bracket mountable to a vehicle body;

a boom mounted to the fixed bracket so as to be vertically swingable about a first horizontal pivot;

an implement mounted to a free-end part of the boom so as to be swingable about a second horizontal pivot;

a mechanical posture maintaining mechanism for maintaining a posture of the implement at least one of:

regardless of swing displacement of the boom; and/or between different swing displacement positions of the boom, wherein:

the boom has a curved shape in which a longitudinal central side of the boom is located above a center-to-center straight line connecting between a center of the first pivot and a center of the second pivot, the posture maintaining mechanism includes:

a swing link member having two free-end parts and disposed at a longitudinal center location of the boom so as to be swingable about a third horizontal pivot;

a base-end link member extending between the fixed bracket and one of the free-end parts of the swing link member; and a free-end link member that links the other free-end part of the swing link member to the implement, the swing link member is configured so that one of the free-end parts serves as an inner free-end part located inward in a boom bending direction from an upper surface of the boom, and the other free-end part serves as an outer free-end part located outward in the boom bending direction from the upper surface of the boom, the boom includes:

a base-end boom part located on the first pivot side from a peak that is furthest from the center-to-center straight line; and a free-end boom part located on the second pivot side from the peak, and in a low position operating state in which the boom is lowered to a height where the implement contacts or substantially contacts a ground surface, the outer free-end part is configured to project forward in a vehicle body longitudinal direction from the free-end part of the boom.

15. The front loader of claim 14, wherein the free-end boom part includes the third pivot.

16. The front loader of claim 14, wherein a center of the third pivot is configured to be located within an area on the second pivot side from a boundary line including the boundary line, the boundary line extending perpendicularly from the center-to-center straight line at substantially a ½ location of a center-to-center distance between the center of the first pivot and the center of the second pivot of the boom.

17. The front loader of claim 14, wherein, in a low position operating state in which the boom is lowered to a height where the implement contacts or substantially contacts the ground surface, an upper end of the outer free-end part is configured to be located below an upper end of the boom in a downward operator line-of-sight direction.

18. The front loader of claim 14, wherein:

a center of the third pivot is configured to be located on the second pivot side from an intersection between a first reference line from the first pivot side of the boom and a second reference line from the second pivot side of the boom;

the first reference line is a line perpendicular to a first perpendicular line at an intersection between the first perpendicular line and the upper surface of the boom, the first perpendicular line extends through the center of the first pivot and intersects perpendicularly to the upper surface of the boom; and the second reference line is a line perpendicular to a second perpendicular line at an intersection between the second perpendicular line and the upper surface of the boom, the second perpendicular line extends through the center of the second pivot and intersects perpendicularly to the upper surface of the boom.

19. The front loader of claim 14, wherein:

the swing link member is configured so a triangular shaped area is formed by:

the third pivot;

a first coupling shaft coupling the inner free-end part to the base-end link member; and a second coupling shaft coupling the outer free-end part to the free-end link member; and in a low position operating state in which the boom is lowered to a height where the implement contacts or substantially contacts the ground surface, an area of about 25% or less is defined on the second coupling shaft side in relation to the triangular shaped area, and a center of the second coupling shaft is exposed outside the boom.

20. The front loader of claim 14, wherein:

the boom includes:

a base-end boom part located on the first pivot side from a peak that is furthest from the center-to-center straight line; and a free-end boom part located on the second pivot side from the peak, and in a low position operating state in which the boom is lowered to a height where the implement contacts or substantially contacts a ground surface, the outer free-end part is configured to be located below the peak.

21. The front loader of claim 14, wherein, the base-end link member is provided with a curved portion that is disposed between the boom and the boom cylinder, and curves so that the curved portion bypasses, on the coupling end side to the inner free-end part, a coupling part located between the boom and the boom cylinder.

* * * * *